US012137850B2

(12) United States Patent
Muraoka et al.

(10) Patent No.: US 12,137,850 B2
(45) Date of Patent: Nov. 12, 2024

(54) WATER DELIVERY INTEGRATED SHOWER SEAT

(71) Applicant: Kohler Co., Kohler, WI (US)

(72) Inventors: Hiroyuki Chanseol Muraoka, New York, NY (US); Lun Cheak Tan, Sheboygan, WI (US); Ka Ming Larry Yuen, Kohler, WI (US)

(73) Assignee: KOHLER CO., Kohler, WI (US)

( * ) Notice: Subject to any disclaimer, the term of this patent is extended or adjusted under 35 U.S.C. 154(b) by 133 days.

(21) Appl. No.: 17/941,988

(22) Filed: Sep. 9, 2022

(65) Prior Publication Data

US 2023/0087947 A1 Mar. 23, 2023

Related U.S. Application Data

(60) Provisional application No. 63/247,513, filed on Sep. 23, 2021.

(51) Int. Cl.
*A47K 3/28* (2006.01)
*E03C 1/04* (2006.01)

(52) U.S. Cl.
CPC ..... *A47K 3/282* (2013.01); *E03C 1/0408* (2013.01)

(58) Field of Classification Search
CPC .. A47K 3/282; A47K 3/28; A47K 3/32; E03C 1/0408
USPC ..... 4/611
See application file for complete search history.

(56) References Cited

U.S. PATENT DOCUMENTS

| | | | | |
|---|---|---|---|---|
| 3,254,615 | A * | 6/1966 | Gay | A61G 7/1059 108/134 |
| 6,195,814 | B1 * | 3/2001 | Yoshida | A47K 3/282 4/601 |
| 2008/0235864 | A1 * | 10/2008 | Masciarelli | A47K 3/282 4/611 |
| 2011/0283450 | A1 * | 11/2011 | Fainberg | A47K 3/122 4/579 |
| 2022/0259841 | A1 * | 8/2022 | Peng | E03C 1/057 |
| 2022/0304873 | A1 * | 9/2022 | Hou | A47K 3/282 |

OTHER PUBLICATIONS

Panasonic Life Solutions India; "Breathing Life Into Bathing The Seated Shower" 17 pages.

* cited by examiner

*Primary Examiner* — Huyen D Le
(74) *Attorney, Agent, or Firm* — FOLEY & LARDNER LLP

(57) ABSTRACT

A shower system includes shower frame, a plurality of nozzles, and a shower seat. The shower frame includes a plurality of substantially coplanar frame segments forming at least part of a perimeter of the shower frame. The plurality of nozzles are distributed across the plurality of substantially coplanar frame segments and configured to spray water inward from the perimeter of shower frame. The shower seat is pivotally connected to the shower frame and configured to pivot between a seated position in which the shower seat is substantially perpendicular to the shower frame and a standing position in which is substantially parallel to the shower frame.

20 Claims, 22 Drawing Sheets

WATER DELIVERY INTEGRATED SHOWER SEAT

CROSS-REFERENCE TO RELATED PATENT APPLICATION

This application claims the benefit of and priority to U.S. Provisional Patent Application No. 63/247,513, filed Sep. 23, 2021, the entire disclosure of which is incorporated by reference herein.

BACKGROUND

The present disclosure relates generally to showers and shower assemblies for bathing. More specifically, the present disclosure relates to shower assemblies including a shower seat.

SUMMARY

At least one embodiment relates to a shower system. The shower system includes shower frame, a plurality of nozzles, and a shower seat. The shower frame includes a plurality of substantially coplanar frame segments forming at least part of a perimeter of the shower frame. The plurality of nozzles are distributed across the plurality of substantially coplanar frame segments and configured to spray water inward from the perimeter of shower frame. The shower seat is pivotally connected to the shower frame and configured to pivot between a seated position in which the shower seat is substantially perpendicular to the shower frame and a standing position in which is substantially parallel to the shower frame.

Another embodiment relates to a shower system. The shower system includes a mounting structure, a shower frame, and a support arm. The mounting structure is configured to be mounted on a substantially vertical surface. The shower frame includes a plurality of substantially coplanar frame segments forming at least part of a perimeter of the shower frame and a plurality of nozzles distributed across the frame segments. The support arm includes a first end pivotally connected to the mounting structure and a second end pivotally connected to the shower frame. The support arm is configured to pivot about the first end to move the shower frame between a first position in which the shower frame is substantially coplanar with the mounting structure and a second position in which the shower frame is offset form the mounting structure.

Another embodiment relates to a shower system. The shower system includes a waterway and a shower seat. The waterway includes a plurality of nozzles. The shower seat includes a seat base and a seat back. The seat base is configured to support a user in a seated position. The seat base includes one or more pressable panels located behind the user in the seated position and configured to control a flow of water to the plurality of nozzles.

This summary is illustrative only and is not intended to be in any way limiting.

BRIEF DESCRIPTION OF THE FIGURES

The disclosure will become more fully understood from the following detailed description, taken in conjunction with the accompanying figures, wherein like reference numerals refer to like elements, in which.

DETAILED DESCRIPTION

Figure 1:
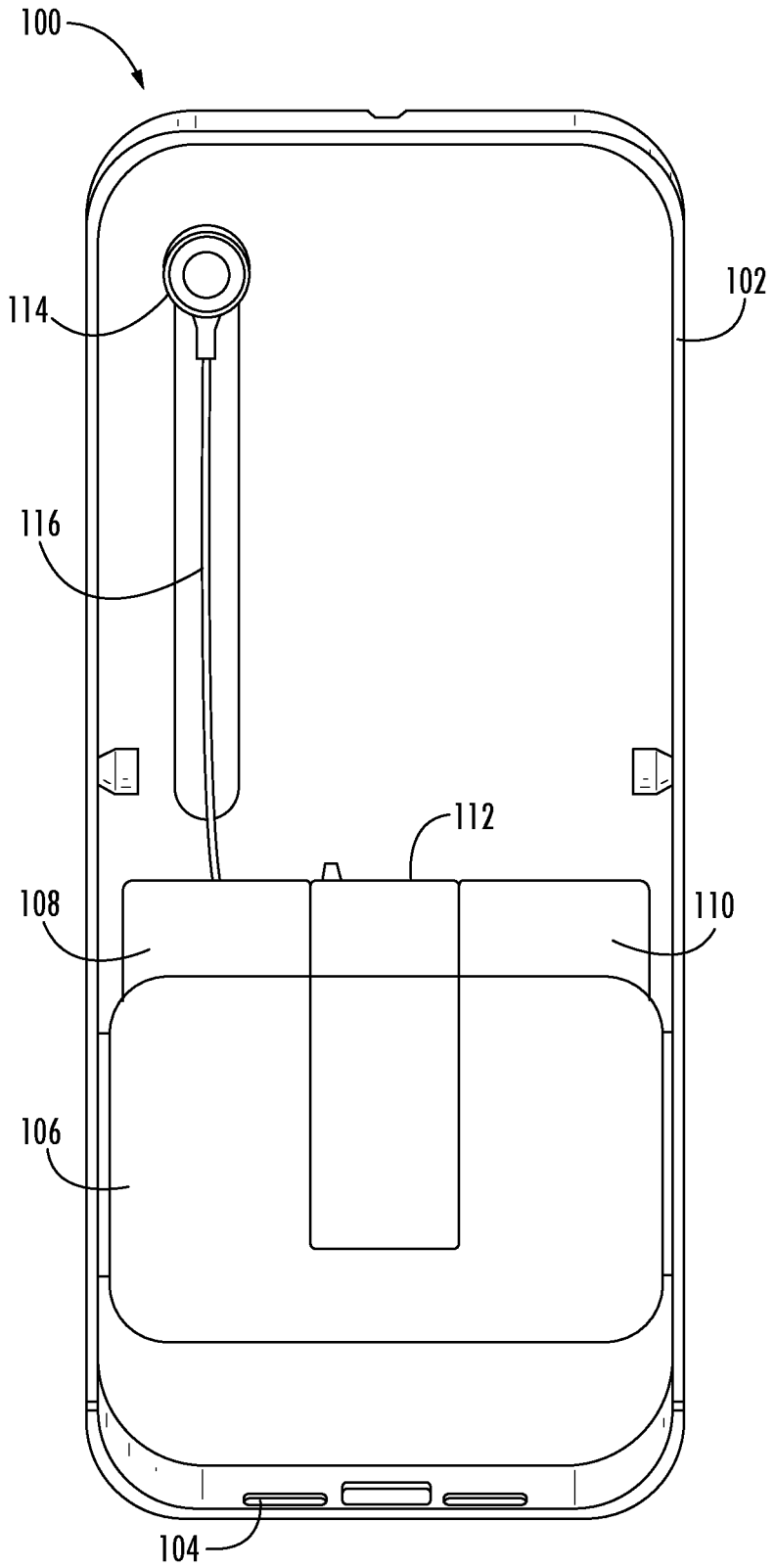
FIG. 1 is a front view of a shower system, according to an exemplary embodiment.

Before turning to the FIGURES, which illustrate certain exemplary embodiments in detail, it should be understood that the present disclosure is not limited to the details or methodology set forth in the description or illustrated in the FIGURES. It should also be understood that the terminology used herein is for the purpose of description only and should not be regarded as limiting. Below are more detailed descriptions of various concepts related to, and implementations of, methods, apparatuses, and assemblies for shower systems. The various concepts introduced above and discussed in greater detail below may be implemented in any of a number of ways, as described concepts are not limited to any particular manner of implementation. Examples of specific implementations and applications are provided primarily for illustrative purposes.

Shower systems are often used to direct the flow of water and carry out a bathing experience in a bathing environment (e.g., bathroom, wet room, etc.). For applications of a shower system in a bathing environment, the shower system is often restricted to only provide water from above and restricted to standing users. Thus, it may be desirable to provide a shower system that may provide a comprehensive bathing experience that provides a user with an option to sit.

Referring generally to the FIGURES, disclosed herein is a shower system for bathing environments (e.g., bathroom, wet room, etc.). The shower system may be reconfigured to allow a user to stand and bathe or sit and bathe.

The shower system includes a plurality of nozzles in a waterway located around (e.g., above, below, left side, right side, behind, etc.) the user that may provide a comprehensive bathing experience. Various configurations of the shower system may be toggled by the user. Advantageously, in some embodiments, the shower system includes enough nozzles such that various body parts of a user may receive water directly from the shower system. The nozzles may be stationary nozzles or may be reoriented, either manually or automatically (e.g., by a controller or actuator) to change the direction in which the directed stream of water is dispensed.

The shower system may further include a system to allow the shower system to switch between a standing configuration and a seated configuration. The seated configuration may include a seat that may be folded down from the standing configuration. When reconfiguring the shower system into the seated configuration, the waterway may adjust to direct water flow toward a seated user (e.g., toward the seat). The shower system may further include a handheld showerhead, which may be able to magnetically couple to the waterway. The shower system may further include large input switches, which may be mechanical or digital, and may be used to control the operation of the shower system and toggle between different settings.

In operation, the nozzles dispense streams of water from different locations (e.g., above the user, from the left of the user, from the right of the user, below the user, behind the user, etc.) through airspace. In this way, the water streams may approach the center area from different angles (e.g., from various locations along the waterway). In the standing configuration, the nozzles point away from the waterway of shower system and towards a user. In the seated configuration, the nozzles are redirected to point inwards. Advantageously, these configurations provide a user with different bathing experiences, depending on preference. A user may also toggle different waterway configurations, such that the flow of water may only be directed from certain sections of the waterway. Advantageously, the toggle switches may be operated by a sitting user.

In various embodiments, the shower system can be wall-mounted or free-standing within a bathing environment. For embodiments in which the shower system is wall-mounted, the shower system may include a rigid mounting structure (e.g., a mounting plate, mounting brackets, a shower back, a housing, etc.) configured to be mounted on a wall or other substantially vertical surface. In some embodiments, the mounting structure is substantially rectangular having a top side, bottom side, left and right sides, a front surface that faces away from the wall when mounted, and a rear surface that faces toward the wall when mounted. In other embodiments, the mounting structure can be circular, elliptical, or have any other shape. The shower system may include support arms pivotally connected to the mounting structure. In some embodiments, the support arms have a first end connected to the left and right side surfaces of the mounting structure. The support arms may be free to rotate about a pivot point at which the first ends connect to the mounting structure. The second ends of the support arms may be pivotally attached to a shower frame.

The shower frame may include a plurality of frame segments including left and right side segments, a top segment, and, in some embodiments, a bottom segment. The frame segments may form a perimeter of the shower frame or at least part of the perimeter (e.g., the top and side edges). In other embodiments, the bottom segment of the shower frame can be omitted such that the shower frame includes only the top and side segments. The left and right side segments of the shower frame can be pivotally attached to the second ends of the support arms. The pivotal connection between the shower frame and the mounting structure via the support arms allows the shower frame to be moved between a standing position in which the shower frame is substantially coplanar with the mounting structure (e.g., the support arms are substantially parallel to the left and right sides of the mounting structure) and a sitting position in which the shower frame is offset from the mounting structure (e.g., the support arms are substantially perpendicular to the mounting structure, extending outward away from the wall). In various embodiments, the shower frame may be substantially parallel to the wall in both the standing and sitting positions, or may be angled relative to the wall in the sitting position. In the sitting position, the bottom frame segment (or feet at the bottom ends of the left and right frame segments) may rest on the floor to provide additional support for the shower frame.

The shower system may include a shower seat hingedly attached to the mounting structure. For example, the bottom edge of the mounting structure may be hingedly attached to the rear edge of the shower seat. In this regard, the mounting structure may function as a back of the shower seat (e.g., a back rest, a seat back) whereas the shower seat may function as a base (e.g., a seat base) configured to support the weight of a user. The hinged connection between the mounting structure and the shower seat may allow the shower seat to pivot between a standing position (e.g., a non-seated position, a non-use position, etc.) in which the shower seat is substantially parallel with the mounting structure and/or substantially parallel or coplanar with the shower frame (e.g., vertical, folded upward such that the mounting structure is located between the shower seat and the wall) and a sitting position in which the shower seat is substantially perpendicular to the mounting structure and/or substantially perpendicular to the shower frame (e.g., horizontal, extending outward from the bottom edge of the mounting structure, away from the wall). The left and right side edges of the shower seat may be pivotally connected to the left and right frame segments of the shower frame. Accordingly, when moving the shower frame from the sitting position to the standing position, both the support arms and the shower seat may pivot relative to the mounting structure and extend away from the wall.

The shower frame may include a plurality of water nozzles (e.g., water outlets, ports, etc.) distributed across the segments of the shower frame. In some embodiments, the shower frame includes water nozzles along the top segment, the left and right side segments, and in some embodiments, along the bottom segment. The water nozzles along the left and right side segments can be located anywhere along the side segments including, for example, a top portion of the side segments that extends between the top segment of the frame and the pivotal connection to the support arms, a middle portion of the side segments that extends between the pivotal connection to the support arms and the pivotal connection to the shower seat, and/or a bottom portion of the side segments that extends between the pivotal connection to the shower seat and the bottom segment (or the feet of the left and right side segments).

The water nozzles and/or frame segments can be configured to spray water inward from the frame segments (e.g., toward a location between the frame segments and/or within a perimeter of the frame) in a direction substantially coplanar with the shower frame (e.g., +/−10 degrees from coplanar, +/−20 degrees from coplanar, +/−30 degrees from coplanar, etc.) or angled toward the wall or away from the wall when the shower system is in the sitting position. The water nozzles and/or frame segments may be oriented to spray water toward a user sitting on the shower seat. In some embodiments, the water nozzles are located on the inside surfaces of the frame segments (i.e., the surfaces that face toward an area between the frame segments) such that the water sprayed from the water nozzles converges toward a user sitting on the shower seat. When the shower system is in the standing position, the water nozzles can be reoriented to spray water outward away from the wall toward a user standing in front of the shower system. In some embodiments, the shower system includes a first set of nozzles that are selectively activated when the shower system is in the standing position and a second set of nozzles that are selectively activated when the shower system is in the sitting position. In some embodiments, the shower system includes a set of nozzles located along the mounting structure that spray water outward, away from the wall, toward a user in the standing position and/or the sitting position.

A user can interact with the shower system via a set of controls, which can be located anywhere on the shower system or on a separate control panel. In some embodiments, the mounting structure includes pressable panels that function as large buttons which can be pressed to provide commands to the shower system (e.g., turn water on/off, change the water spray pattern, change the temperature of the water, etc.). The pressable panels may occupy a significant portion of the front surface of the mounting structure (e.g., one-third, two-thirds, at least one square foot in area, at least two square feet in area, etc.) to allow the pressable panels to be easily pressed by a user when sitting on the shower seat and/or when vision is obscured by water. For example, a user sitting on the shower seat may be facing away from the mounting structure with his/her back toward the wall. The user can extend his/her arm backward and press the pressable panels with his/her elbow. In some embodiments, the shower system includes a left pressable panel and a right pressable panel located along the front surface of the mounting structure, adjacent to the left and right side edges respectively. In some embodiments, water temperature can be controlled by a slider located along the top edge or other surface of the mounting structure. These and other features and advantages of the shower system are described in greater detail below.

FIG. 1 is a front view of a shower system 100, according to an exemplary embodiment. In this embodiment, the shower system 100 is configured in the standing position. The shower system 100 is configured for installation in a bathing environment. More specifically, the shower system 100 is mounted on a wall. Standard showering systems (e.g., those comprising a single shower head) can often only shower a user with water coming from a singular direction. In standard showering systems, the user often stands or sits on a separate seat. When seated the user may not have easy access to redirecting the showerhead. The shower system 100 provides a system that provides a comprehensive bathing experience for a standing or seated user and is operable from both the standing and seated position.

The shower system 100 includes a waterway 102. The waterway 102 directs water from a water supply (e.g., water source in a plumbing system). The waterway 102 may be formed of various materials suitable for carrying water (e.g., polyethylene (PEX), polyvinyl chloride, (PVC), copper pipe, acrylonitrile butadiene styrene (ABS), galvanized steel, cast iron, etc.). The waterway 102 includes a housing that forms a rectangular shape with rounded corners with a plurality of nozzles 104 arranged around the housing, the nozzles 104 fluidly coupled to the waterway 102. The nozzles 104 may be arranged into groups that dispense water flow in tandem. In some embodiments, the waterway 102 may include additional devices (e.g., motors, actuators, etc.) that may change the direction of the nozzles 104. In some embodiments, the nozzles 104 may include a valve (e.g., ball valve, solenoid valve, etc.) configured to open and close the nozzles 104. In some embodiments, the waterway 102 may include a magnetic component configured to magnetically couple to a showering accessory (e.g., showerhead, etc.). In some embodiments, the waterway 102 may include a pressurization device (e.g., pressurizer, etc.) to control (e.g., increase or decrease) the pressure of the water leaving the nozzles 104.

The shower system 100 includes a shower seat 106. When pulled down from the standing configuration the shower seat 106 provides the user with a sitting surface. The shower seat 106 is hingedly coupled (e.g., coupled with a rotatable hinge) to the rest of the shower system 100. The shower seat 106 may be formed from a material suitable for repeated exposure to moisture (e.g., treated wood, stainless steel, aluminum, plastic, etc.) and to withstand the full weight of a user.

The shower system 100 is controlled by an operably coupled activation switch 108. The activation switch 108 either activates (e.g., directs to dispense water) the shower system 100 or turns off (e.g., block flow of water) the shower system 100. The activation switch 108 may be a mechanical switch or an electronic switch (e.g., switches an electric current). In some embodiments, the activation switch 108 may directly open and close a valve that can cut off the supply of water to the shower system 100. In some embodiments, when the activation switch 108 is an electronic switch, the activation switch 108 electrically couples to a controller. The controller is configured to control the function of the shower system 100. For example, the activation switch 108 sends a signal to the controller that in turn opens a digital valve that allows for a flow of water into the shower system 100. In some embodiments, the activation switch 108 may include a combination of mechanical and electronic components.

The shower system 100 is further controlled by an operably coupled toggle switch 110. When activated, the toggle switch 110 alters the water flow configuration of the shower system 100. For example, when the toggle switch 110 is pressed, water may flow to different nozzles 104 within the waterway 102. The toggle switch 110 may be a mechanical switch or an electronic switch. In some embodiments, the toggle switch 110 may operate valves within the nozzles 104 such that the valves open and close corresponding to some configuration. For example, when the toggle switch 110 is operated, all valves except for one may close. In some embodiments, the toggle switch 110 operates valves within a manifold that directs water to nozzles 104 within the waterway 102. The toggle switch 110 may be a mechanical switch or an electronic switch. In some embodiments, when the toggle switch 110 is an electronic switch, the toggle switch 110 electrically couples to a controller. In some embodiments, the toggle switch 110 may include a combination of mechanical and electronic components.

The shower system 100 is further controlled by a temperature slider 112. The temperature slider 112 adjusts the temperature of the water exiting the nozzles 104. In some embodiments, the temperature slider 112 adjusts the mixture of hot water and cold water entering or existing the shower system 100. In some embodiments, the temperature slider 112 may adjust the setting on a heating element (e.g., induction coil, boiler, etc.) configured to heat the water entering or exiting the shower system 100. The temperature slider 112 slides from a first position (cold water position) to a second position (hot water position). The temperature slider 112 may be a mechanical device or an electrical device. The temperature slider 112 may be a mechanical device or an electrical device. In some embodiments, the temperature slider 112 may have a combination of electrical and mechanical components. In some embodiments, the temperature slider 112 may be a dial configured to rotate from a first position to a second position.

In some embodiments, such as the depicted embodiment, the shower system 100 includes a handheld showerhead 114 fluidly coupled to the rest of the shower system 100 by a showerhead conduit 116. The handheld showerhead 114 is configured to allow a user to selectively direct water flow through the handheld showerhead 114. The showerhead conduit 116 may be formed of various flexible materials suitable for carrying water (e.g., PEX, PVC, ABS, etc.). The handheld showerhead 114 may be mounted directed on the waterway 102 or on the wall.

Figure 2:
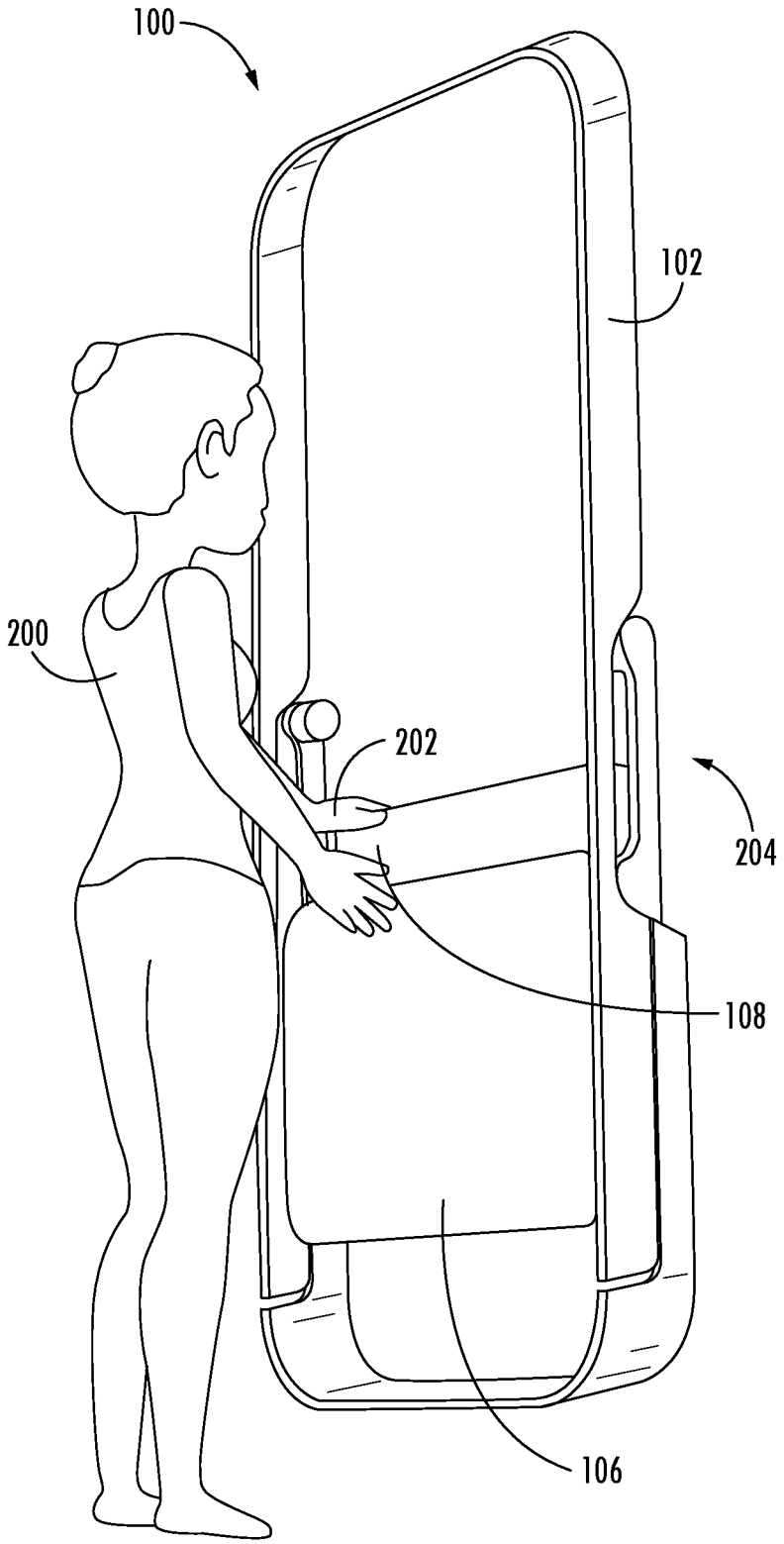
FIG. 2 is a perspective view of a user interacting with the shower system of FIG. 1, according to an exemplary embodiment.

FIG. 2 is a perspective view of a user 200 interacting with the shower system 100 of FIG. 1 with an arm 202, according to an exemplary embodiment. The shower system 100 is mounted against a wall 204 and the shower seat 106 is folded up, such that the waterway 102 is in the standing configuration. The user 200 stands upright in front of the shower system 100 and uses the arm 202 to operate the activation switch 108. The user 200 operates the activation switch 108 when the user 200 desires for water flow from the shower system 100.

Figure 3:
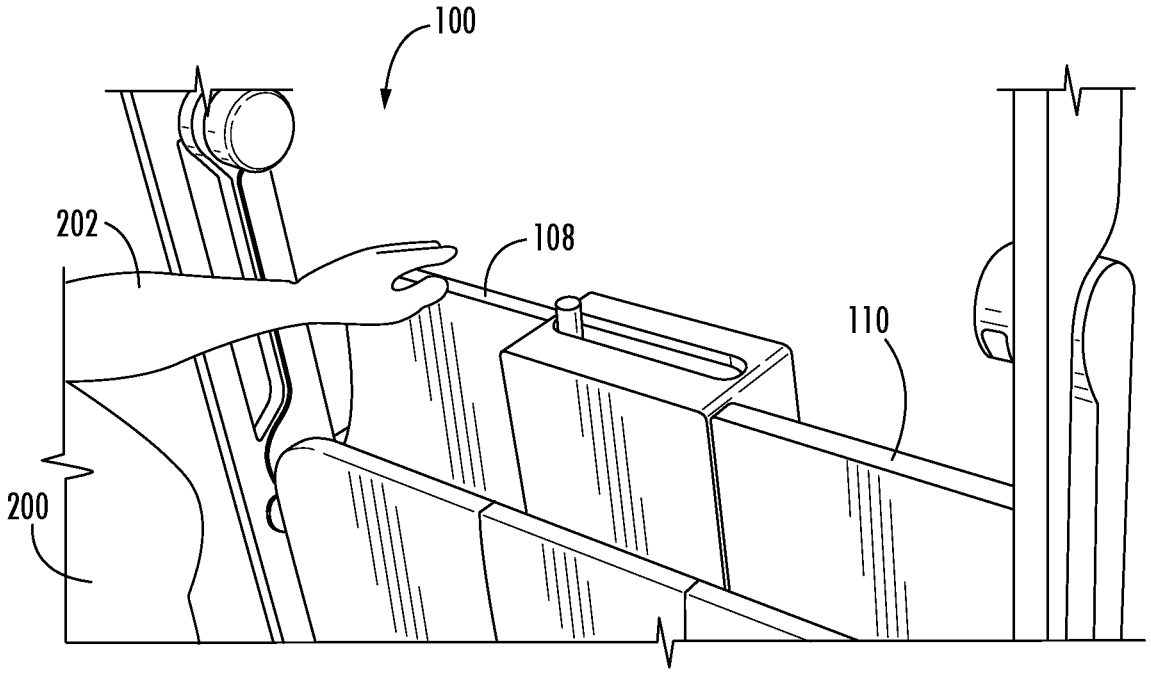
FIG. 3 is a perspective view of a portion of a user interacting with shower system of FIG. 1, according to an exemplary embodiment.

FIG. 3 is a perspective view of a portion of the user 200 interacting with the shower system 100 of FIG. 1. As shown in FIG. 3, the user 200 depresses the activation switch 108 with the arm 202 to operate the activation switch 108. In some embodiments, the activation switch 108 may include a mechanical component configured to provide the user 200 with haptic feedback when the activation switch 108 has been operated. The user 200 may also repeat this process for the toggle switch 110. The user 200 may depress the toggle switch 110 multiple times until the desired configuration is chosen.

Figure 4:
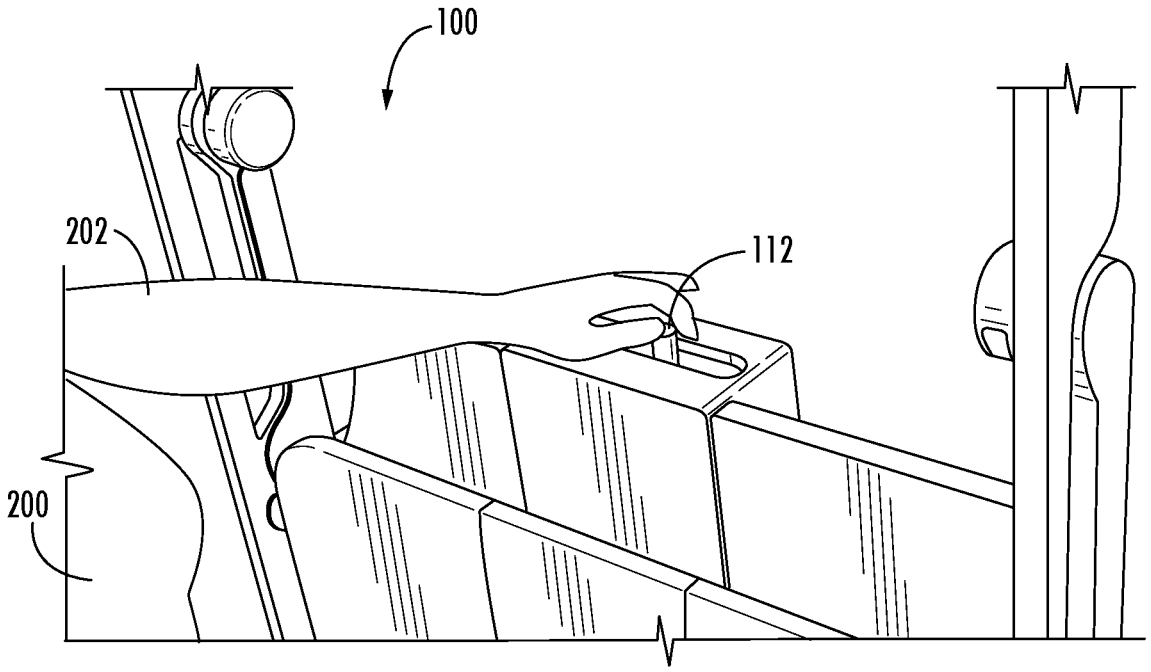
FIG. 4 is a perspective view of a portion of a user interacting with the shower system of FIG. 1, according to an exemplary embodiment.

FIG. 4 is a perspective view of a portion of the user 200 interacting with the shower system 100 of FIG. 1. The user 200 uses the arm 202 to adjust the temperature slider 112 to a desired position corresponding to a temperature of the water exiting the shower system 100. The temperature slider 112 may be used during operation of the shower system 100 or may be used to adjust the temperature of the water prior to the activation of the activation switch 108.

Referring generally to FIGS. 5-8, a user 200 stands in front of a shower system 100. The shower system 100 is configured to bathe the standing user 200. The user 200 may switch between bathing configurations using the toggle switch 110. In some embodiments, the user 200 selects a configuration by pressing the toggle switch 110 a number (e.g., 1, 2, 3, 4, 5, 6, etc.) of times. In some embodiments, the user 200 selects a configuration by pressing the toggle switch 110 for a predetermined amount of time (e.g., 2 seconds, 3 seconds, 4 seconds, etc.) corresponding to a configuration.

Figure 5:
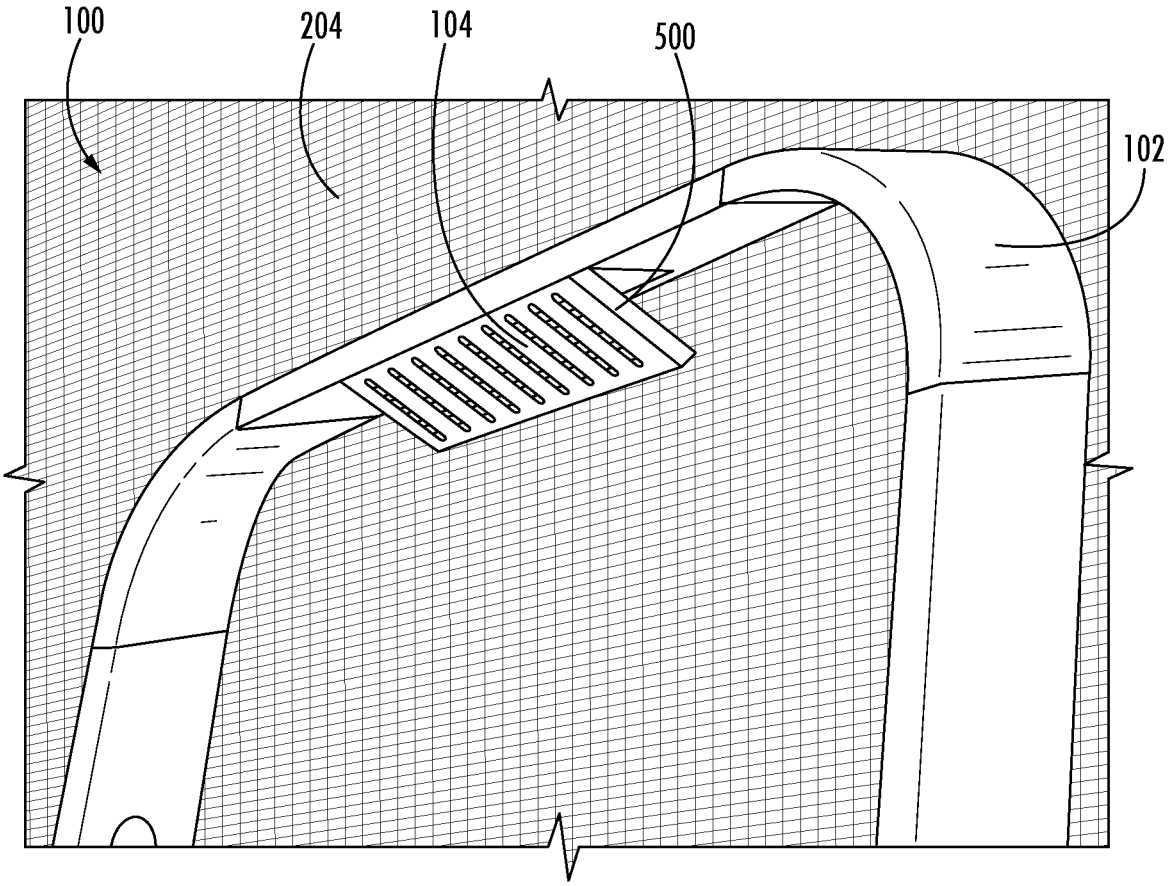
FIG. 5 is a perspective view of a portion of a shower system, according to another exemplary embodiment.

FIG. 5 is a perspective view of a portion of the shower system 100, according to an exemplary embodiment. The nozzles 104 of the shower system 100 are arranged in a nozzle array 500. In some embodiment, the nozzles 104 may be arranged in the nozzle array 500 in a specific pattern. In this embodiment, the nozzle array 500 is located at the top of the waterway 102 and is oriented to direct water outward, away from the wall 204. The nozzle array 500 is hingedly coupled to the waterway 102 such that the angle may be reoriented. Reorientation of the nozzle array 500 may be manual (e.g., by a user), by a mechanical device (e.g., pulley, etc.), or an electrical device (e.g., motor, etc.), or any combination thereof. In some embodiments, the waterway 102 may include multiple sets of nozzles 104 in various configurations to allow for the waterway 102 to direct water in various directions. A plurality of nozzle arrays 500 are arranged around the waterway 102. Each nozzle array 500 may be hingedly coupled to the waterway 102.

Figure 6:
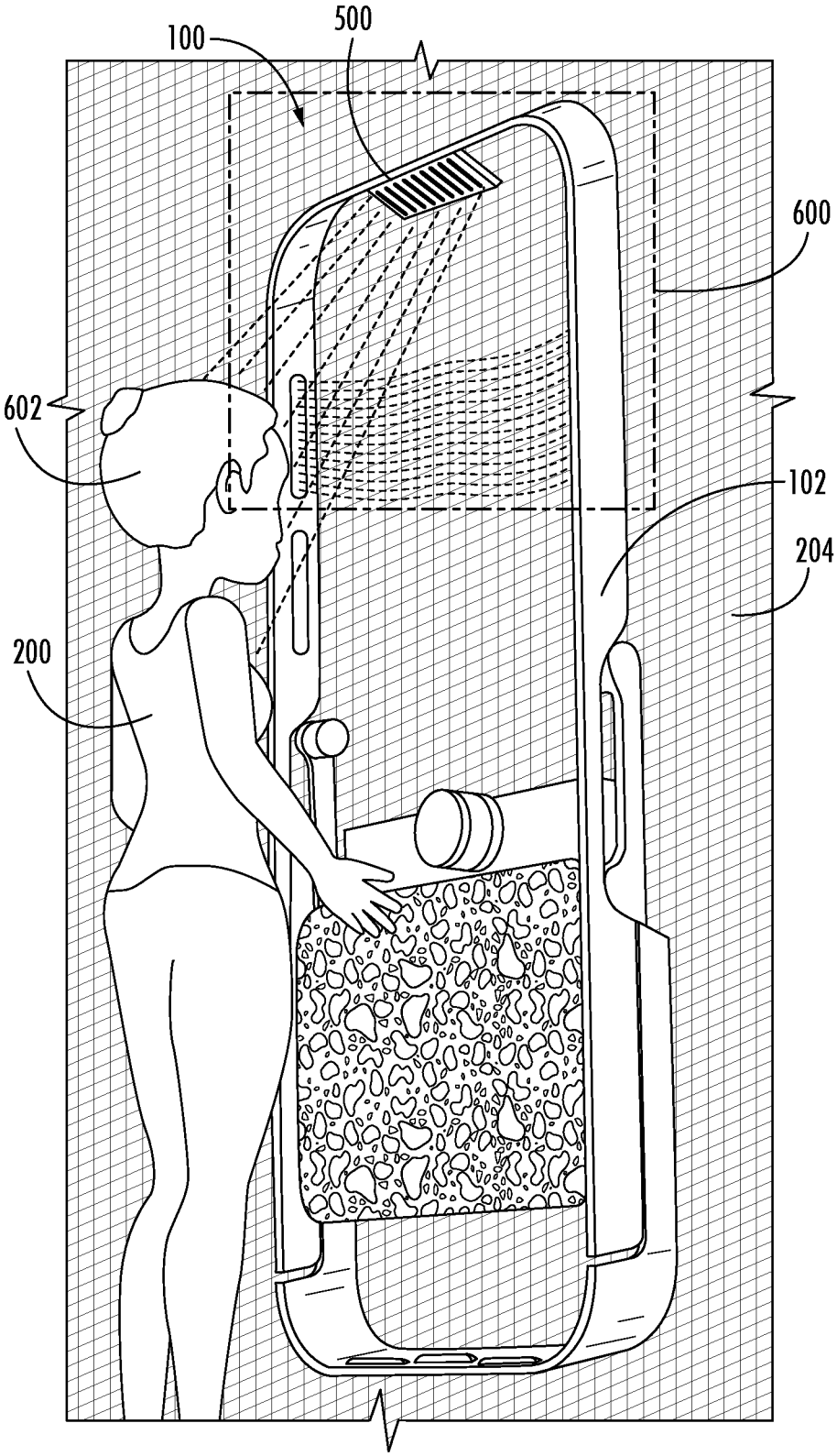
FIG. 6 is a perspective view of a user interacting with the shower system of FIG. 5, according to another exemplary embodiment.

FIG. 6 is a perspective view of a user 200 interacting with the shower system 100 of FIG. 5 during operation, according to an exemplary embodiment. The shower system 100 is configured to only dispense water from nozzle arrays 500 in a top portion 600 of the waterway 102. In the depicted embodiment, the nozzle arrays 500 direct water out away from the wall 204 and towards a head 602 of the user 200. In some embodiments, the nozzle arrays 500 may be adjusted to accommodate users 200 of varying heights.

Figure 7:
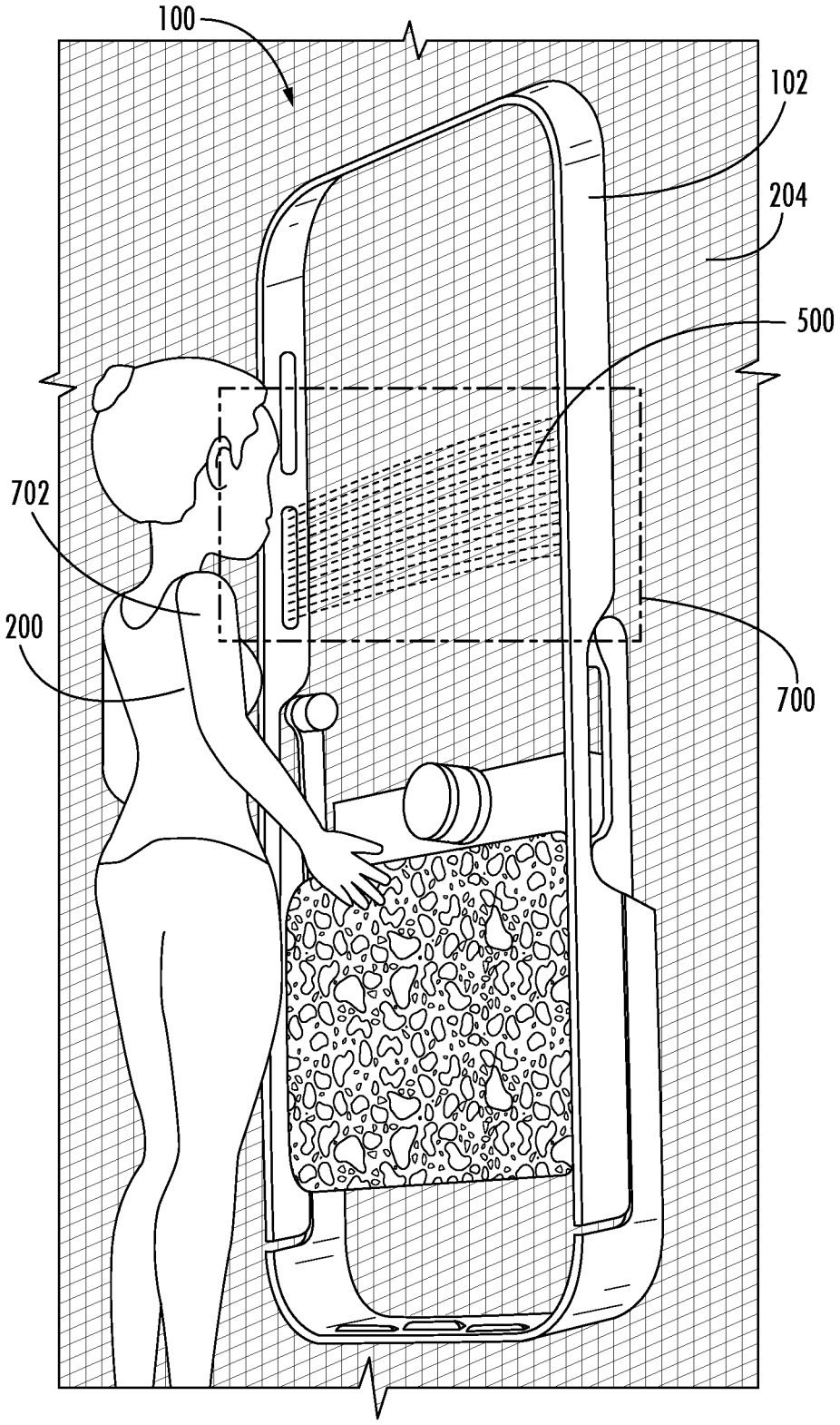
FIG. 7 is a perspective view of a user interacting with the shower system of FIG. 5, according to another exemplary embodiment.

FIG. 7 is a perspective view of a user 200 interacting with the shower system 100 of FIG. 5 during operation, according to another exemplary embodiment. The shower system 100 is configured to only dispense water from nozzle arrays 500 in a middle portion 700 of the waterway 102. In the depicted embodiment, the nozzle arrays 500 direct water out away from the wall 204 and towards a torso 702 of the user 200. In some embodiments, the nozzle arrays 500 may be adjusted to accommodate users 200 of varying heights.

Figure 8:
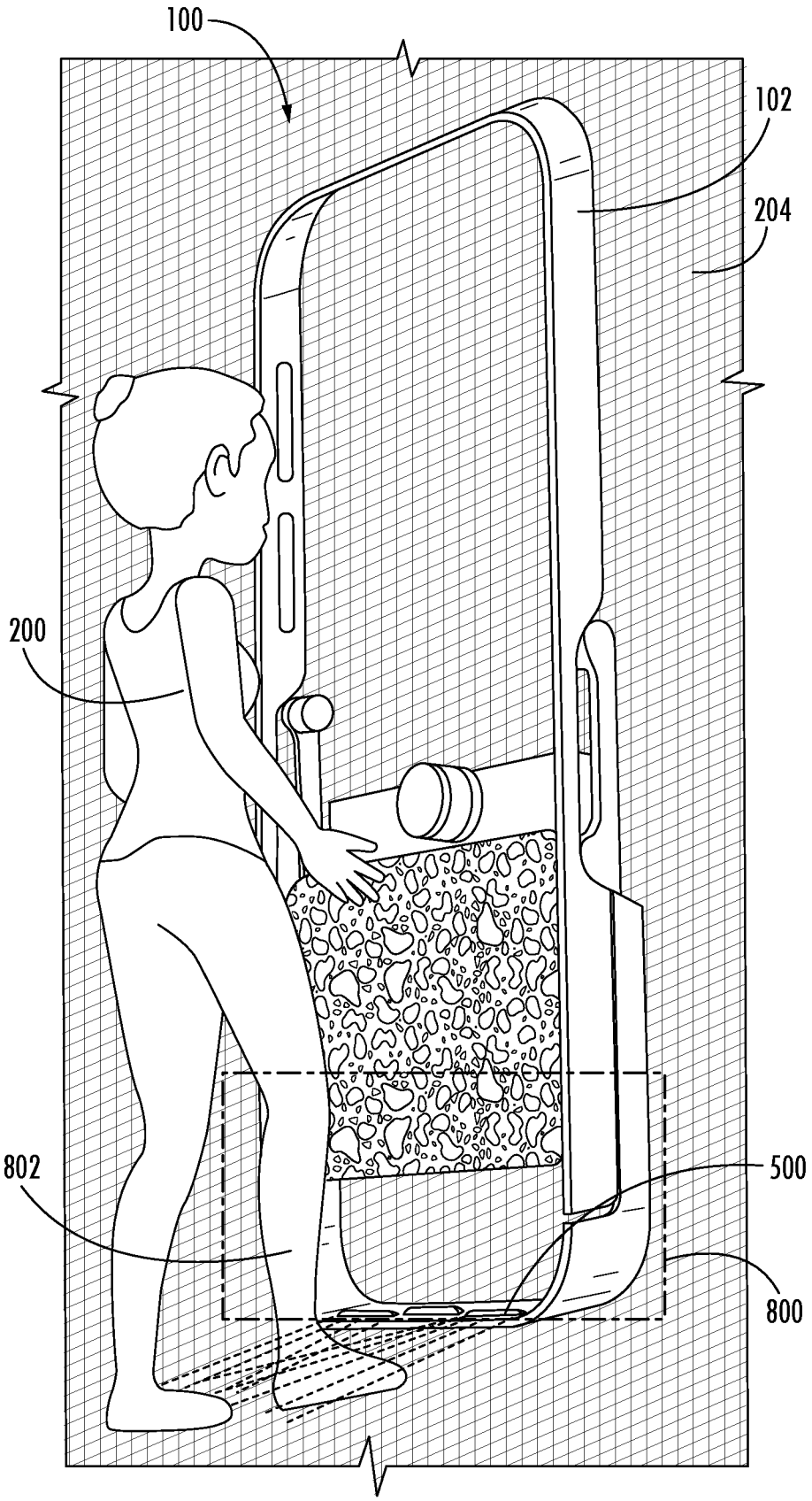
FIG. 8 is a perspective view of a user interacting with the shower system of FIG. 5, according to another exemplary embodiment.

FIG. 8 is a perspective view of a user 200 interacting with the shower system 100 of FIG. 5 during operation, according to another exemplary embodiment. The shower system 100 is configured to only dispense water from nozzle arrays 500 in a bottom portion 800 of the waterway 102. In the depicted embodiment, the nozzle arrays 500 direct water away from the wall 204 and towards the feet 802 of the user 200. This configuration allows the user 200 to check the temperature of the water with the feet 80 of the user 200. Checking the temperature allows the user 200 to adjust the water to a desired temperature prior to switching to a different configuration. This provides the user 200 with a comfort benefit, as the user 200 can avoid water, out of a desired temperature range, contacting sensitive body parts. An additional benefit is that operating only the bottom portion 800 reduces water waste while the user 200 is adjusting the temperature of the water.

Figure 9:
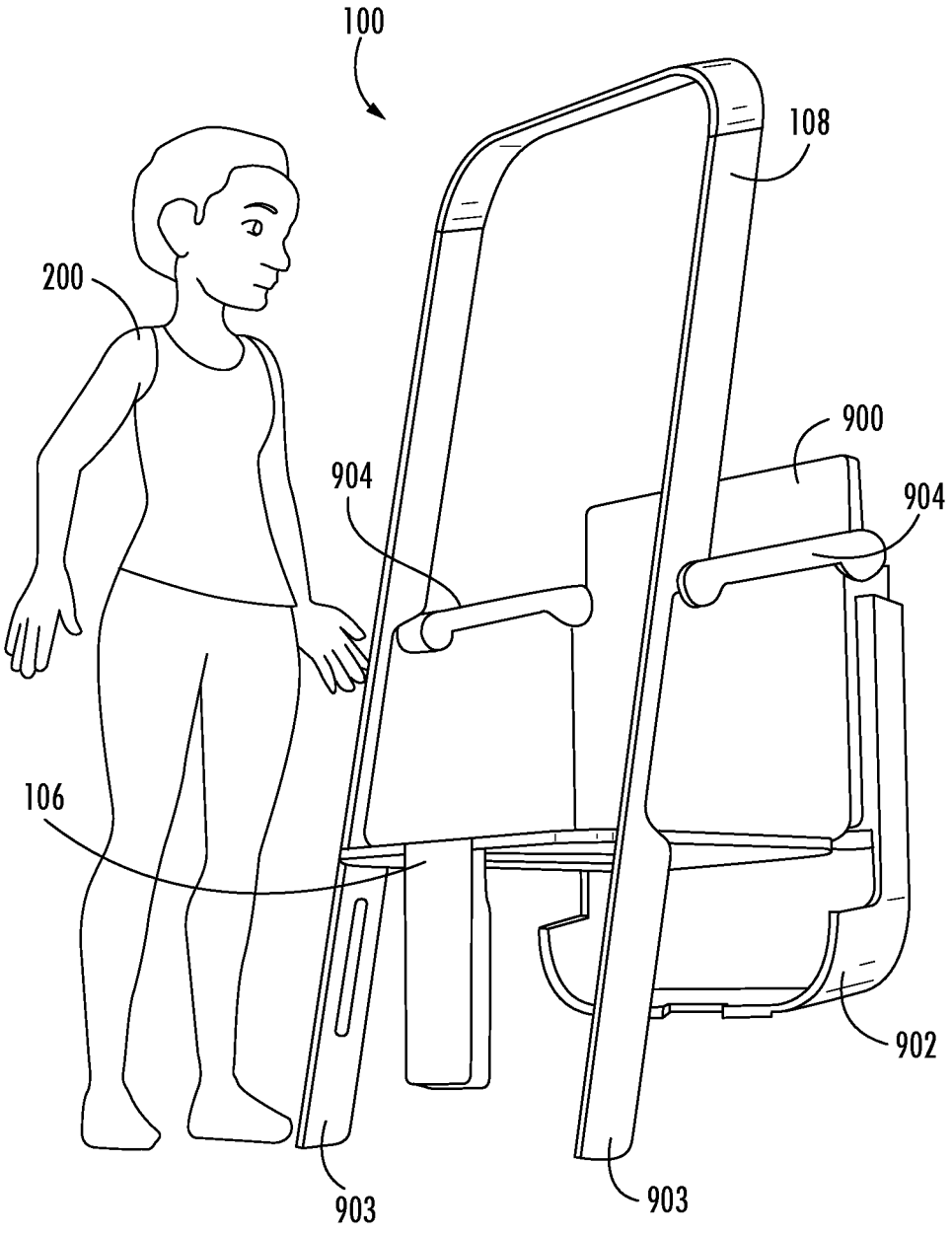
FIG. 9 is a perspective view of a user interacting with a shower system, according to another exemplary embodiment.

FIG. 9 is a perspective view of a user 200 with a shower system 100 in a sitting configuration. To reconfigure the shower system 100 from the standing configuration, such as in FIG. 2, to the sitting configuration, the user 200 pulls down the waterway 102 such that the shower seat 106, rotatably coupled to the waterway 102, rotates away from the shower back 900 until the shower seat 106 is parallel with the floor of the bathing environment. The waterway 102 pulls away from a bottom waterway 902 such that the waterway 102 forms an inverted U-shape. As such, the waterway 102 and the bottom waterway 902 may define a waterway assembly. The length of each vertical portion of the waterway 102 is configured such that the shower seat 106 is parallel to the floor of the bathing environment when feet 903 of the waterway 102 contact the floor of the bathing environment. In some embodiments, the feet 903 of the waterway 102 include a gripping device (e.g. rubber, silicone, etc.) that provide sufficient (e.g., such that the feet 903 don't slip) grip with the floor of the bathing environment.

The waterway 102 rotatably couples to the shower back 900 via two supports 904. The supports 904 support the waterway 102 such that the waterway 102 stays in position once the shower system 100 is in the sitting configuration. In some embodiments, the supports 904 include a locking mechanism that prevents further rotation until a release device (e.g., switch, button, etc.) is activated. The supports 904 further includes a fluid conduit made from a material suitable for carrying water that directs water to the waterway 102. The fluid conduit fluidly couples the waterway 102 to the shower back 900. The shower back 900 is further fluidly coupled to a hot water line and a cold water line. In some embodiments, the hot water and the cold water are mixed in the shower back 900.

In some embodiments, when switching between the standing configuration and the sitting configuration of the shower system 100, the shower system 100 may automatically detect a change in configuration and adjust the nozzles 104 such that they are in correct configuration. In other embodiments, a user 200 may need to manually adjust the nozzles 104.

Figure 10:
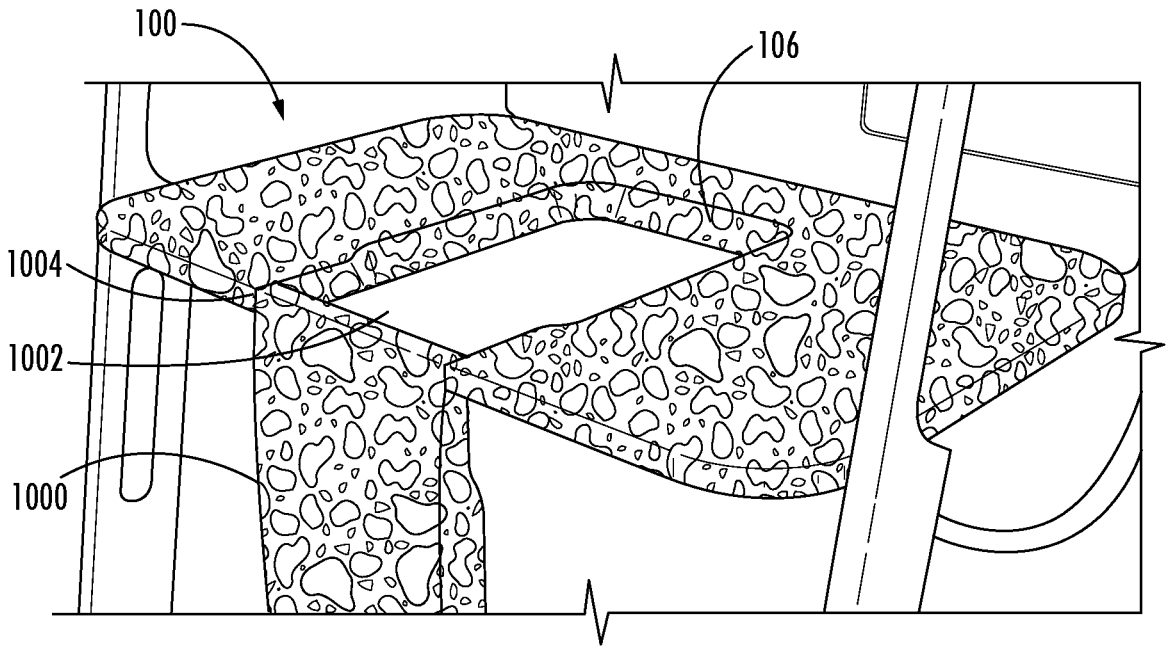
FIG. 10 is a perspective view of a portion of a shower system, according to another exemplary embodiment.

FIG. 10 is a perspective view of a portion of the shower system 100 in the sitting configuration, according to an exemplary embodiment. The shower seat 106 includes a shower seat flap 1000 that rotates away from rest of the shower seat 106. The shower seat flap 1000 can be rotated from a closed position to an open position. The shape of the shower seat flap 1000 is configured such that in the closed position, the shower seat flap 1000 rests on shower seat 106. In some embodiments, the shower seat flap 1000 selectively couples to the shower seat 106 with a fastening device (e.g., hook-and-loop, adhesive, etc.). In the open position, the shower seat 106 has an opening 1002. The opening 1002 allows for water to flow through the opening 1002 from below. The shower seat flap 1000 is coupled to the shower seat 106 by a hinge 1004. In some embodiments, the shower seat flap 1000 may be removed from the shower seat 106.

Figure 11:
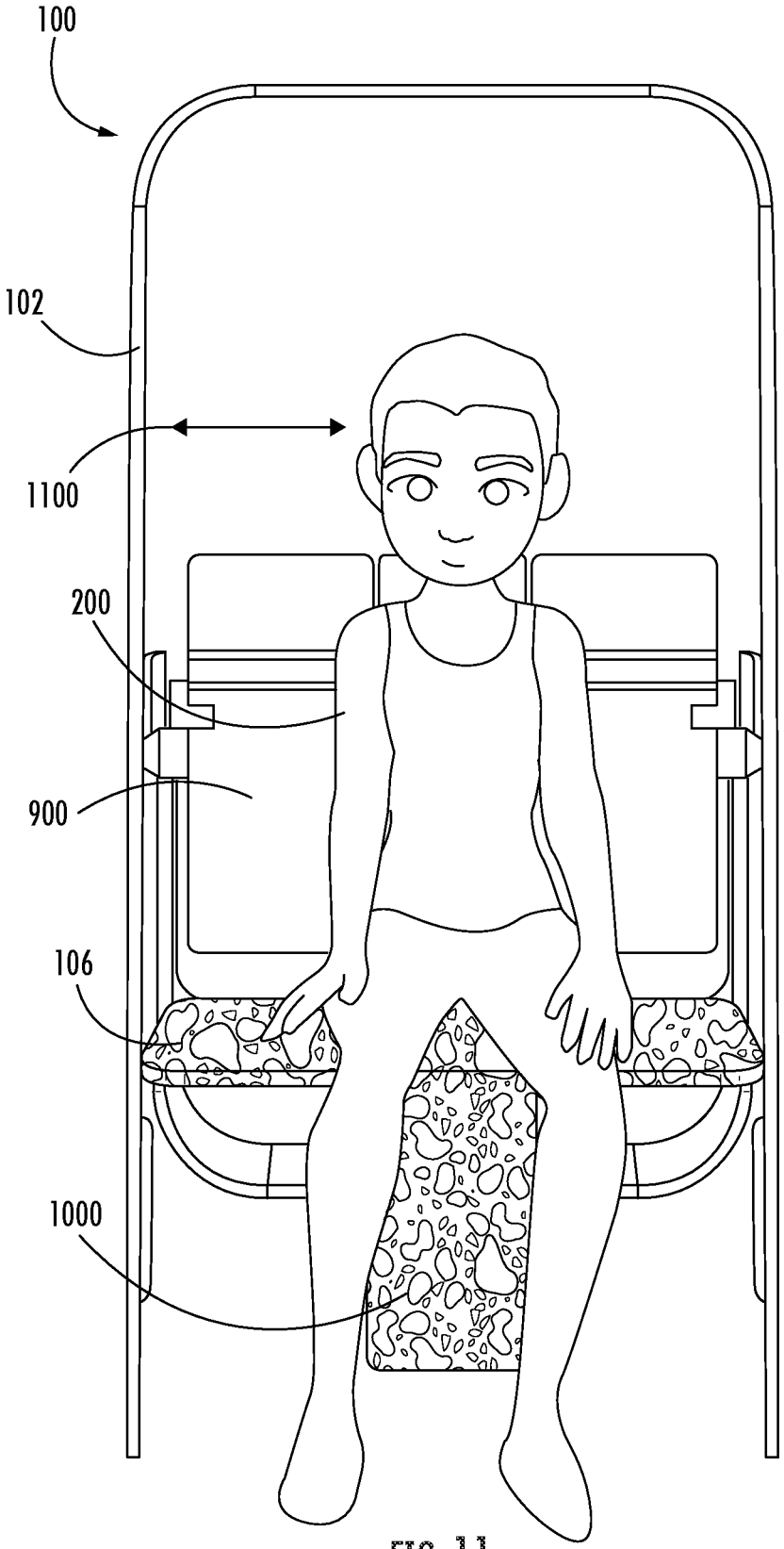
FIG. 11 is a perspective view of a user interacting with the shower system of FIG. 9, according to an exemplary embodiment.

FIG. 11 is a front view of a user 200 sitting on the shower seat 106 of the shower system 100, according to an exemplary embodiment. The shower seat 106 provides the user 200 with a surface for the user 200 to sit down on. The user 200 may sit on the shower seat 106 with the shower seat flap 1000 in the open position or in the closed position. A benefit of the shower seat 106 is that it is wide such that the shower seat 106 may accommodate (e.g., be able to sit comfortably) users 200 of various sizes. In some embodiments, the shower seat 106 is sufficiently wide such that there is additional space 1100 between the user 200 and the waterway 102. A benefit of having additional space 1100 between the user 200 and the waterway 102 is that the water leaving the waterway 102 slows down by the time it reaches the user 200. This slowdown in water speed produces a more pleasant showering experience for the user 200.

Figure 12:
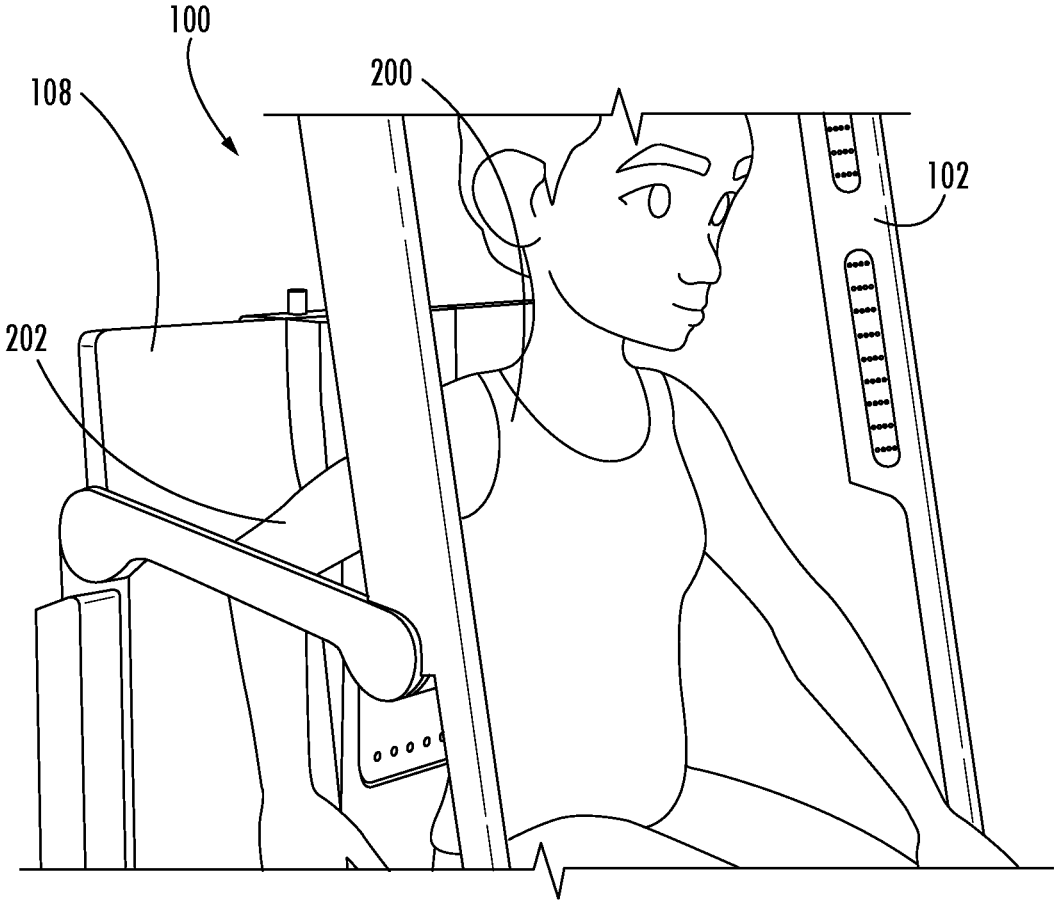
FIG. 12 is a perspective view of a portion of a user interacting with the shower system of FIG. 9, according to an exemplary embodiment.

FIG. 12 is a perspective view of a sitting user 200 interacting with a shower system 100, according to an exemplary embodiment. The user 200 uses an arm 202 to activate the activation switch 108. The activation switch 108 is sufficiently large such that the activation switch 108 may be activated by the user 200 while the user 200 is facing forward in a seated position.

Figure 13:
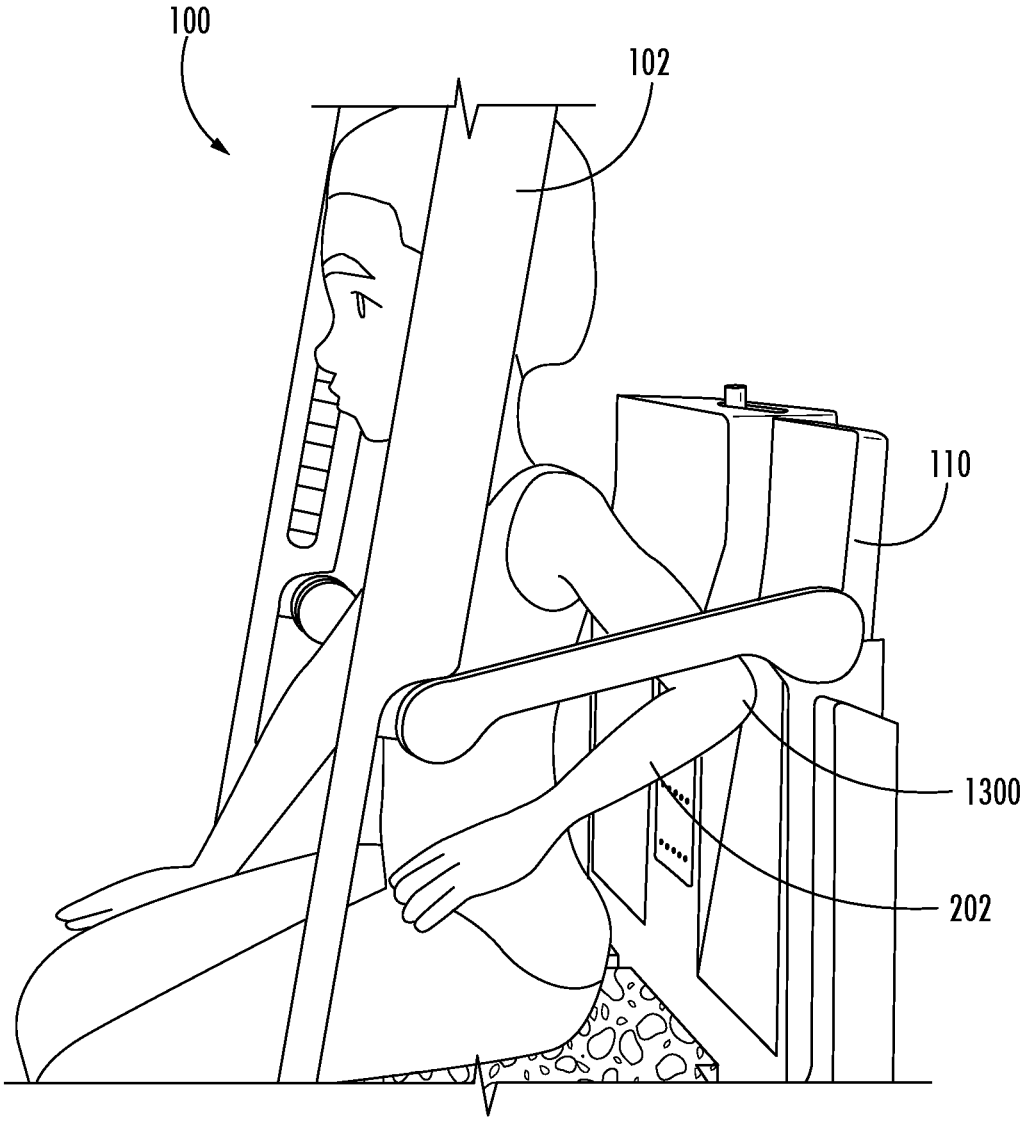
FIG. 13 is a side view of a portion of a user interacting with the shower system of FIG. 9, according to an exemplary embodiment.

FIG. 13 is a perspective view of a sitting user 200 interacting with a shower system 100, according to an exemplary embodiment. The user 200 uses an arm 202, and more specifically an elbow 1300 to activate the toggle switch 110. The toggle switch 110 is sufficiently large such that the toggle switch 110 may be activated by the user 200 while the user 200 is facing forward in a seated position.

Referring generally to FIGS. 14-20, the shower system 100 is configured to bathe a user 200 in the sitting configuration. When in the sitting configuration, the shower system 100 is configured to direct water from the waterway 102 into the airspace between the waterway 102 towards a seated user 200. The user 200 may switch between bathing configurations using the toggle switch 110. In some embodiments, the user 200 selects a configuration by pressing the toggle switch 110 a number of times. In some embodiments, the user 200 selects a configuration by pressing the toggle switch 110 for a predetermined amount of time corresponding to a configuration. In some embodiments, the shower system 100 may include additional water flow configurations not shown in the FIGURES.

Figure 14:
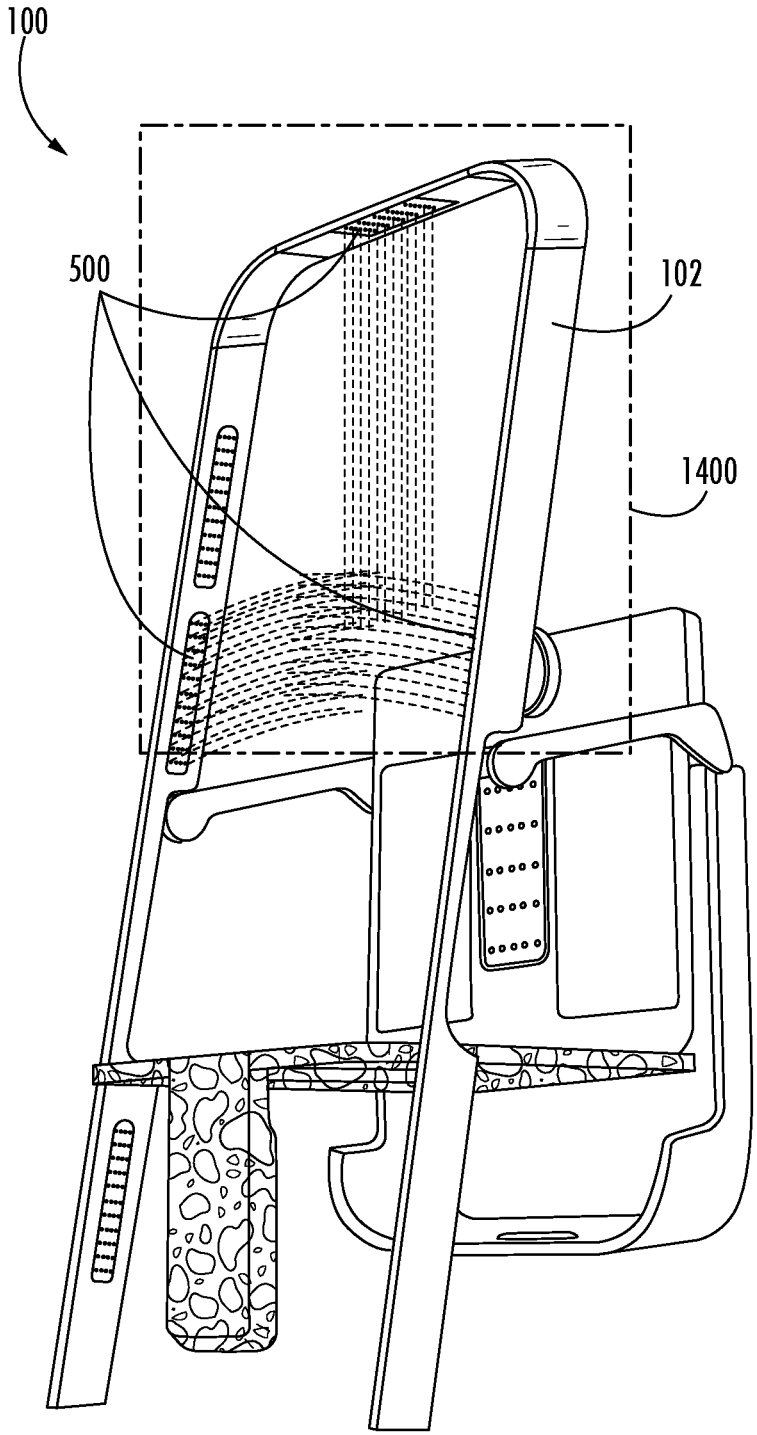
FIG. 14 is a perspective view of a shower system, according to another exemplary embodiment.

FIG. 14 is a perspective view of a shower system 100 in the sitting configuration, according to another exemplary embodiment. In this embodiment, the waterway 102 is configured to deliver water only from nozzle arrays 500 in the top sitting portion 1400 of the waterway 102.

Figure 15:
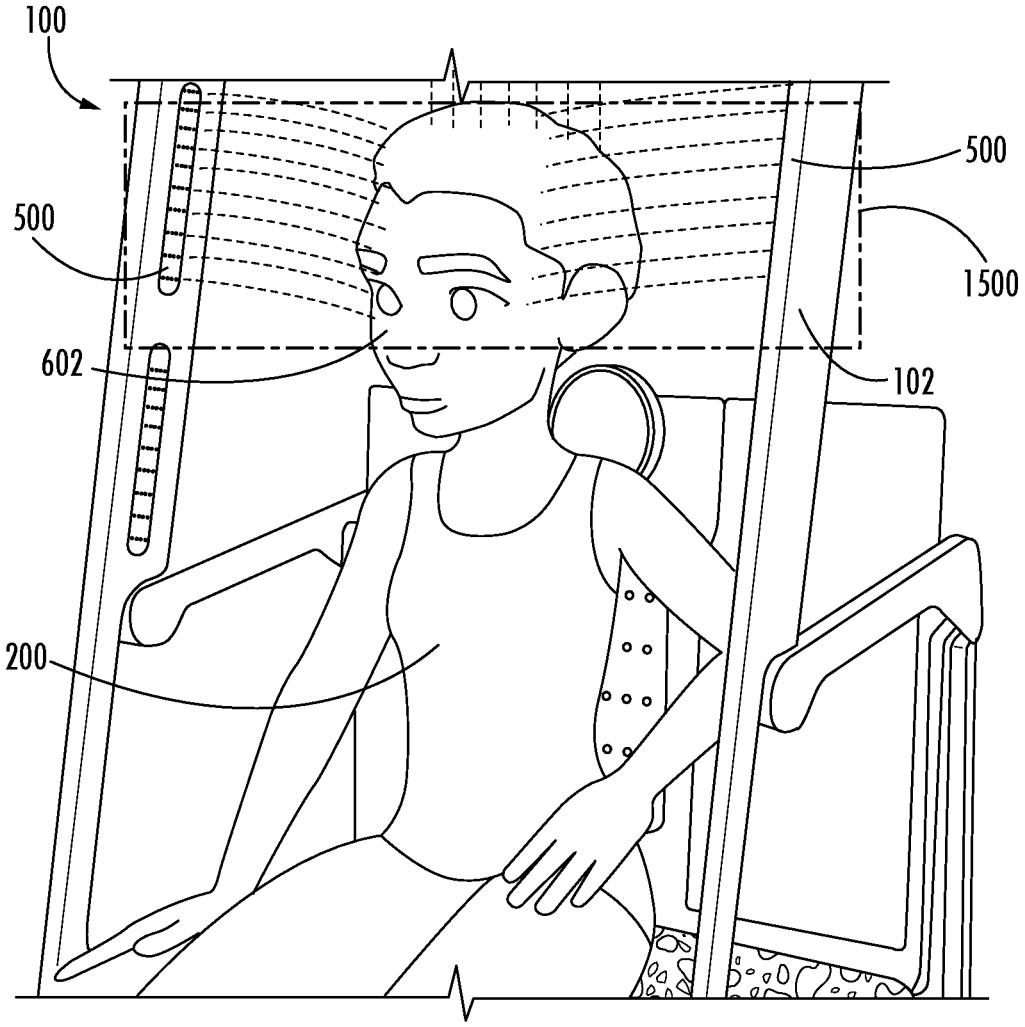
FIG. 15 is a perspective view of a user interacting with the shower system of FIG. 14, according to an exemplary embodiment.
Figure 16:
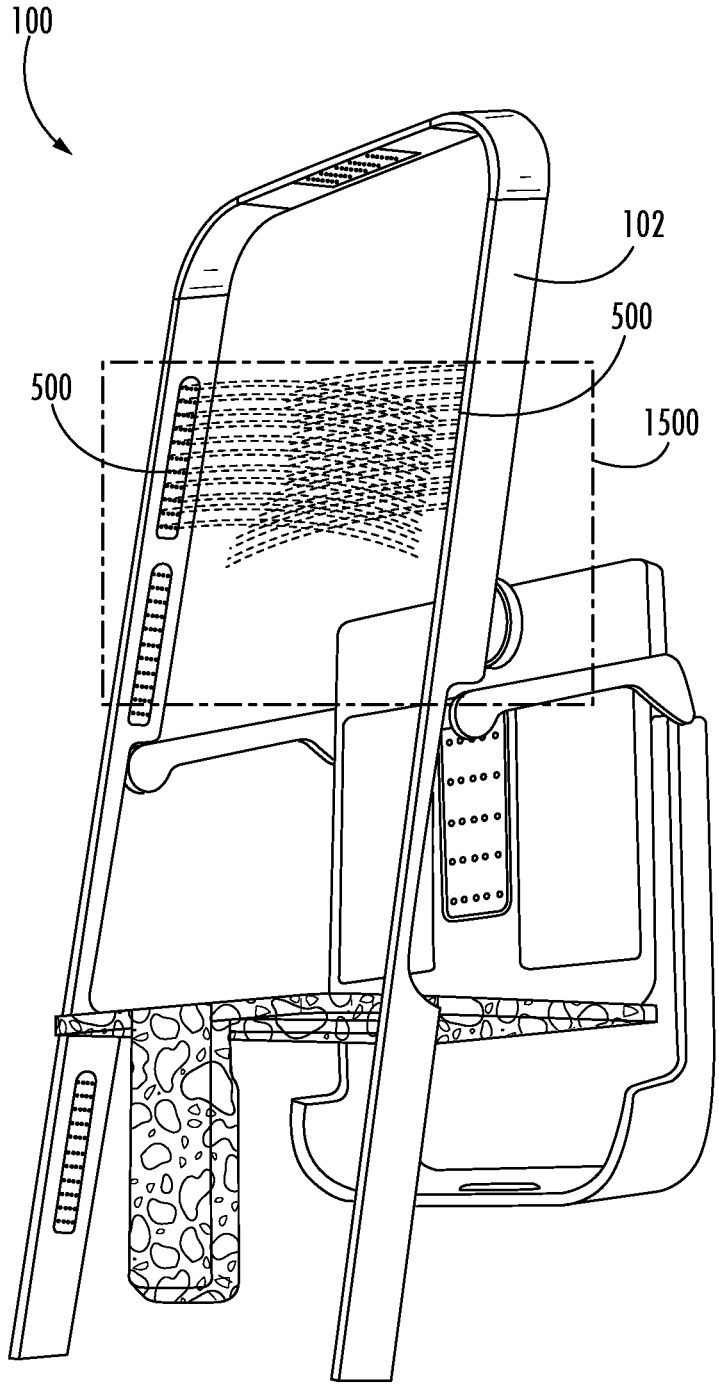
FIG. 16 is a perspective view of the shower system of FIG. 15 without the user, according to another exemplary embodiment.

FIG. 15 is a perspective view of a user 200 interacting with the shower system 100 of FIG. 14, according to an exemplary embodiment. The user 200 is seated in the shower system 100. In this embodiment, the shower system 100 only directs water from nozzle arrays 500 in the waterway 102 within a head portion 1500. The waterway 102 directs water towards a head 602 of the user 200. FIG. 16 is a perspective view of the shower system 100 of FIG. 15 without the user 200.

Figure 17:
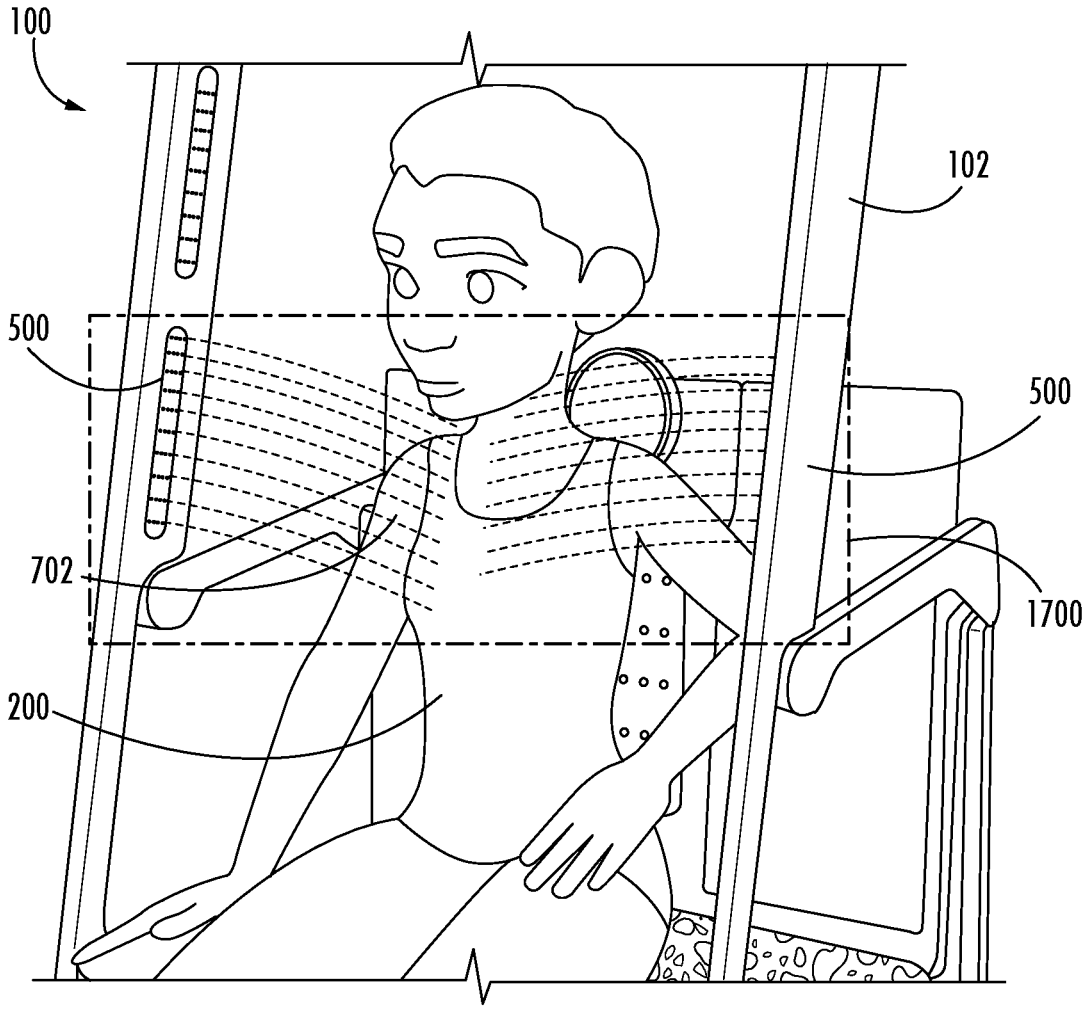
FIG. 17 is a perspective view of a user interacting with the shower system of FIG. 14, according to another exemplary embodiment.

FIG. 17 is a perspective view of a user 200 interacting with the shower system 100 of FIG. 14, according to an exemplary embodiment. The user 200 is seated in the shower system 100. In this embodiment, the shower system 100 only directs water from nozzle arrays 500 in the waterway 102 within a torso portion 1700. The waterway 102 directs water towards a torso 702 of the user 200.

Figure 18:
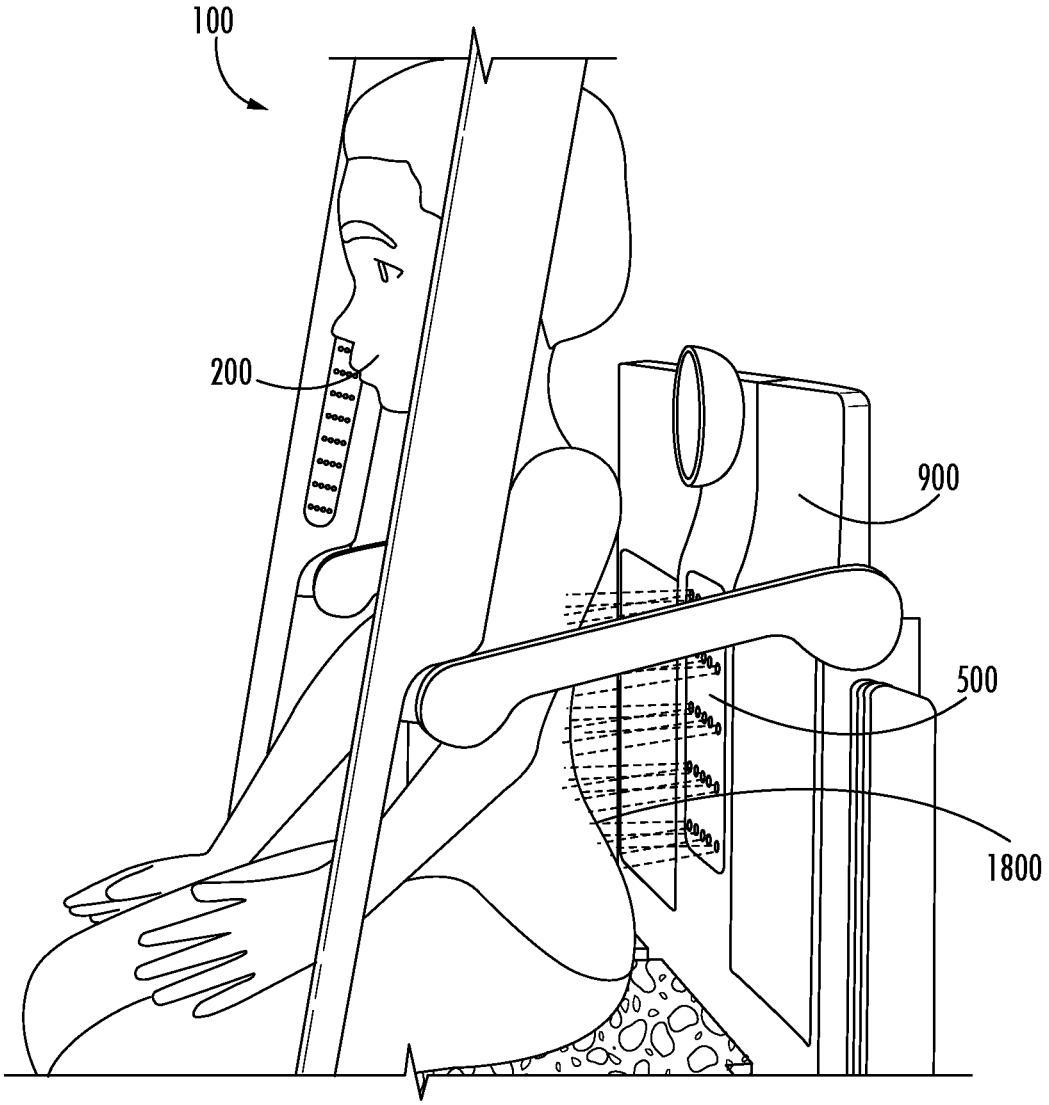
FIG. 18 is a side view of a user interacting with the shower system of FIG. 14, according to another exemplary embodiment.

FIG. 18 is a side view of a user 200 interacting with the shower system 100 of FIG. 14, according to a particular embodiment. The user 200 is seated in the shower system 100. The shower system 100 is configured to direct water from a nozzle array 500 on the shower back 900 towards a back 1800 of the user 200. In some embodiments, the nozzle array 500 on the shower back 900 includes a massage setting. The massage setting may include varying water quality (e.g., spray angle, etc.) and pressure (e.g., alternating between low and high pressure, etc.).

Figure 19:
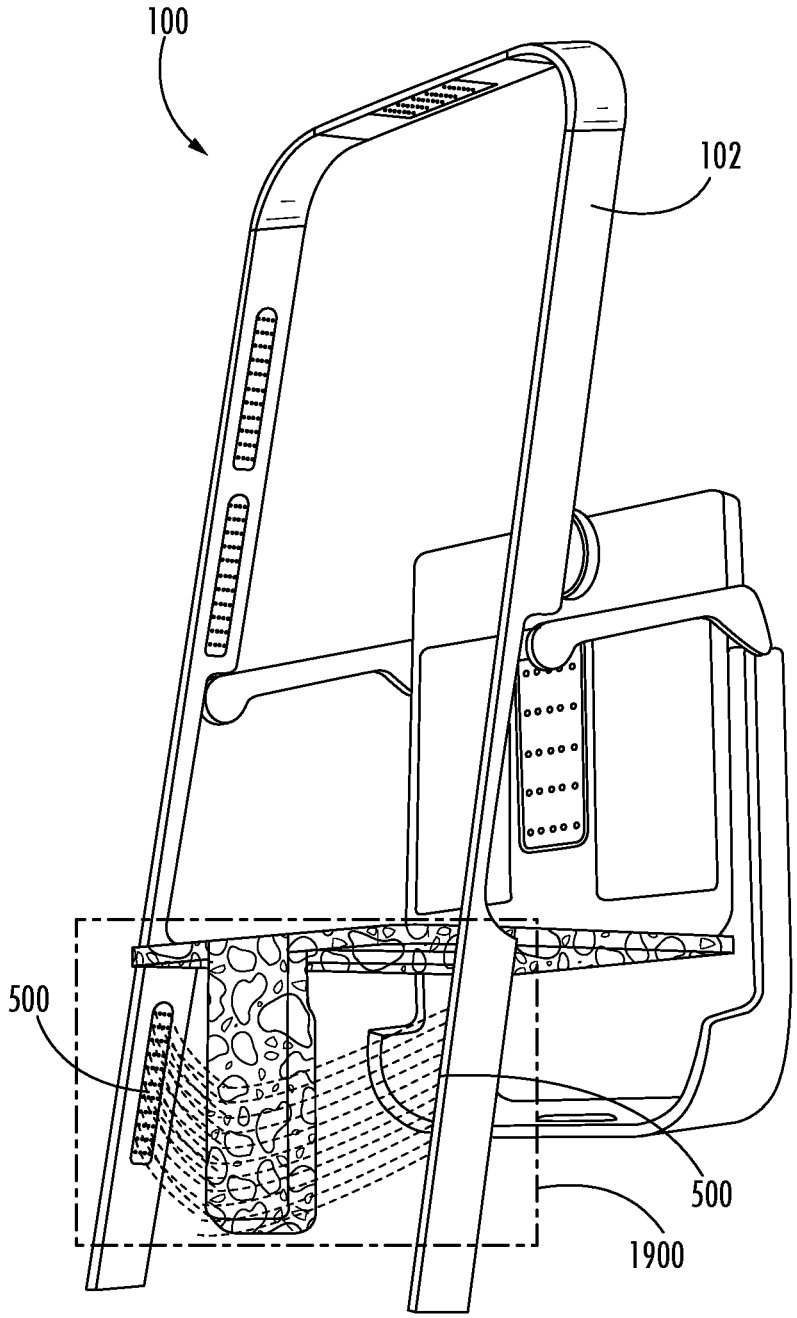
FIG. 19 is a perspective view of the shower system of FIG. 14, according to another exemplary embodiment.

FIG. 19 is a perspective view of the shower system 100 of FIG. 14, according to another exemplary embodiment. The shower system 100 is configured to only direct water from the nozzle arrays 500 of the leg portion 1900 of the waterway 102.

Figure 20:
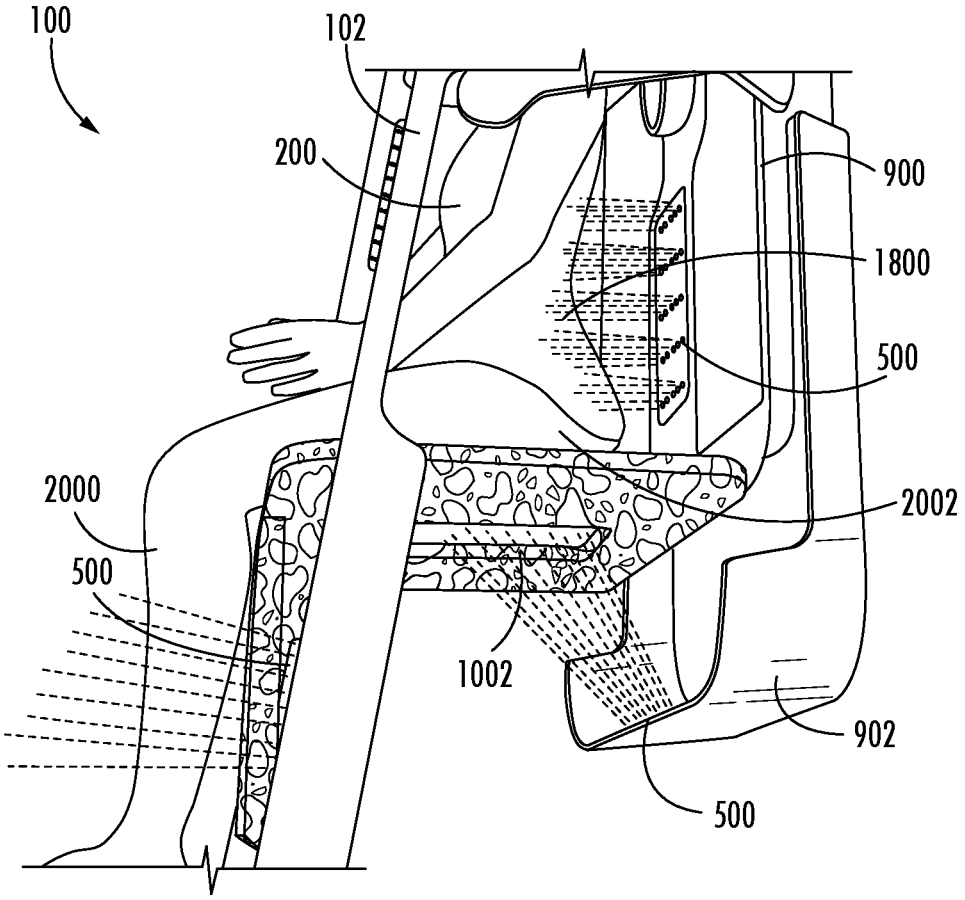
FIG. 20 is a side view of a user interacting with the shower system of FIG. 14, according to another exemplary embodiment.

FIG. 20 is a perspective view of a user 200 interacting with the shower system 100 of FIG. 14, according to another exemplary embodiment. In this configuration, the nozzle arrays 500 of the waterway 102 are configured to direct water toward the legs 2000 of the user 200. Additionally, the nozzle array 500 of the bottom waterway 902 sprays water through the opening 1002 towards the thighs 2002 of the user 200. Additionally, in this configuration, the nozzle array 500 on the shower back 900 is directed to spray water on the back 1800 of the user 200. This configuration provides the user 200 with a comprehensive lower body bathing experience.

Figure 21:
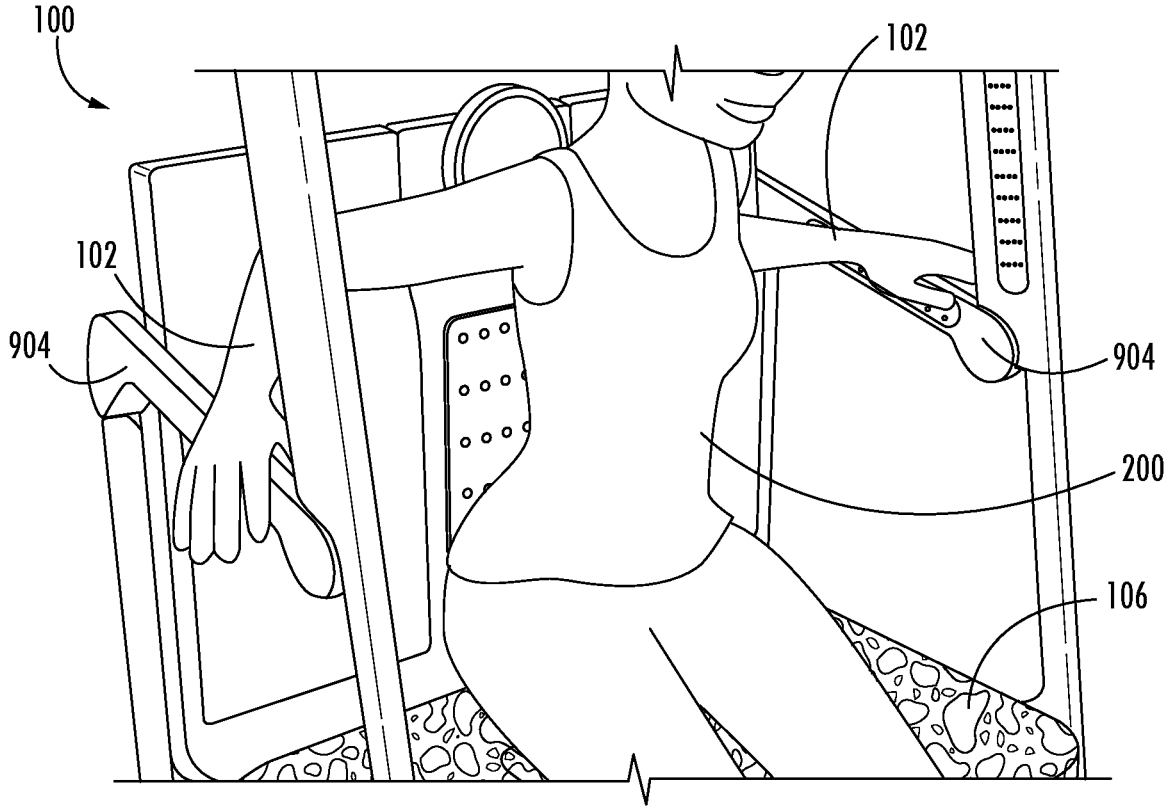
FIG. 21 is a perspective view of a user interacting with the shower system, according to another exemplary embodiment.

FIG. 21 is a perspective view of a user 200 interacting with the shower system 100, according to another exemplary embodiment. The supports 904 are configured such that the user 200 uses the arms 202 to stand up off the shower seat 106. The supports 904 are capable of withstanding (e.g., not deforming, not breaking, etc.) the loads associated with the weight of the user 200 when the user 200 uses the supports 904 to stand up. In some embodiments, each support 904 is capable of withstanding the full load of the user 200. In some embodiments, the supports 904 include internal strengthening components configured to strengthen (e.g., distribute load, absorb load, etc.) the supports 904.

Figure 22:
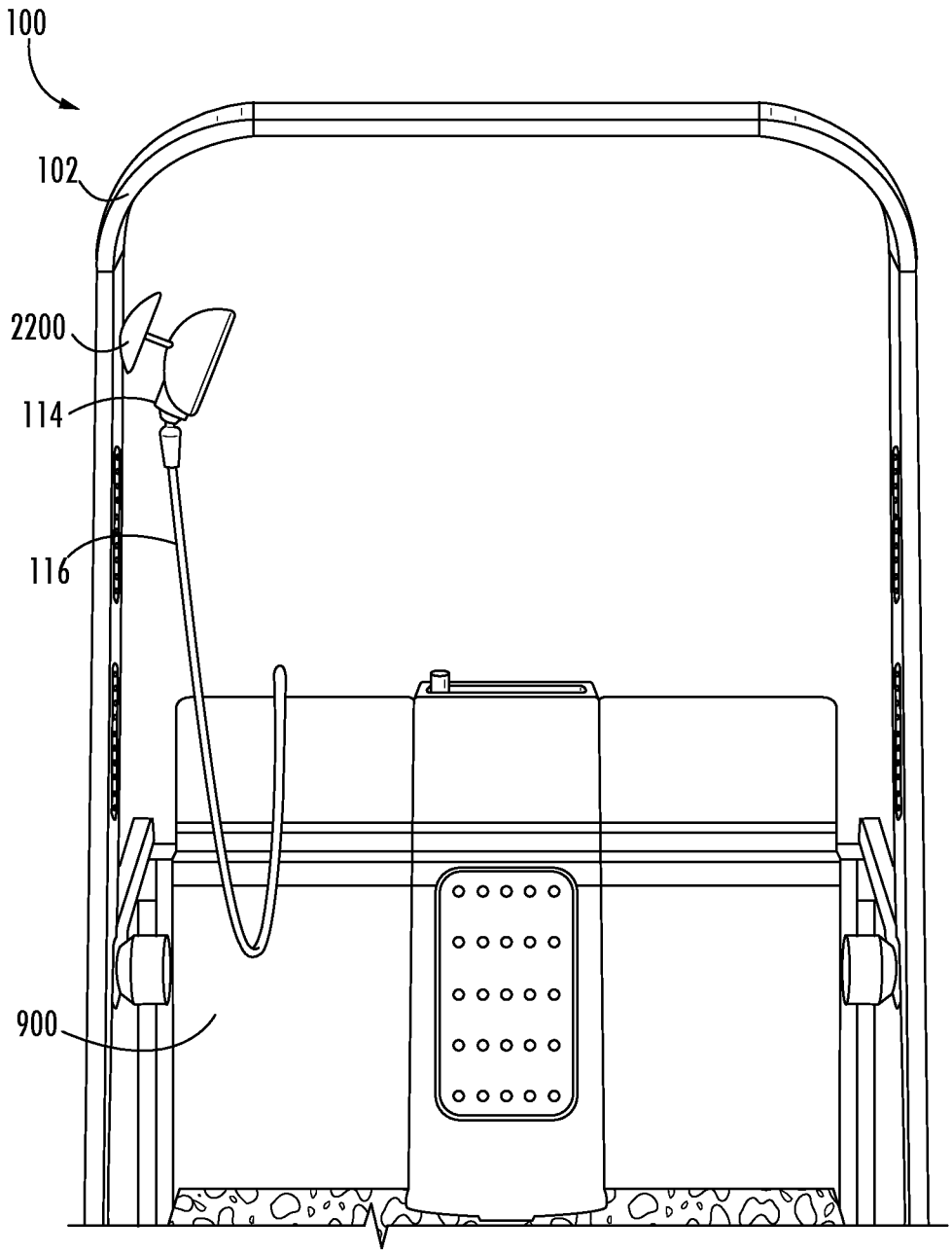
FIG. 22 is a front view of a shower system, according to an exemplary embodiment.

FIG. 22 is a front view of handheld showerhead 114 coupled to a magnet 2200 magnetically coupled to the waterway 102. In some embodiments, the waterway 102 may include an attachment point (e.g., adhesive, hook, slot, etc.) on which the handheld showerhead 114 may selectively couple (e.g., may be removed and reattached). Coupling the handheld showerhead 114 to the waterway 102 allows for easy access to the handheld showerhead 114 or allows for a user to customize the direction of water flow.

It should be noted that the term "exemplary" and variations thereof, as used herein to describe various embodiments, are intended to indicate that such embodiments are possible examples, representations, or illustrations of possible embodiments (and such terms are not intended to connote that such embodiments are necessarily extraordinary or superlative examples).

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled direction to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

References herein to the positions of elements (e.g., "top," "bottom," "above," "below") are merely used to describe the orientation of various elements in the FIGURES. It should be noted that the orientation of various elements may differ according to other exemplary embodiments, and that such variations are intended to be encompassed by the present disclosure.

The present disclosure contemplates methods, systems, and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, or other optical disk storage, magnetic disk storage or other magnetic storage devices, or any other medium which can be used to carry or store desired program code in the form of machine-executable instructions or data structure and which can be accessed by a general purpose or special purpose computer or other machine with a processor. Combinations of the above are also included in the scope of machine-readable media. Machine-executable instructions include, for example, instructions and data which cause a general purpose computer, special purpose computer, or special purpose processing machines to perform a certain function or group of functions.

Although the figures and description may illustrate a specific order of method steps, the order of such steps may differ from what is depicted and described, unless specified differently above. Also, two or more steps may be performed concurrently or with partial concurrence, unless specified differently above. Such variation may depend, for example, on the software and hardware systems chosen and on designer choice. All such variations are within the scope of the disclosure. Likewise, software implementations of the described methods could be accomplished with standard programming techniques with rule-based logic and other logic to accomplish the various connection steps, processing steps, comparison steps, and decision steps.

It is important to note that the construction and arrangement of the system as shown in the various exemplary embodiments is illustrative only. Additionally, any element disclosed in one embodiment may be incorporated or utilized with any other embodiment disclosed herein. For example, the system of the exemplary embodiment described with reference to FIG. 22 may be incorporated in the system of the exemplary embodiment described with reference to FIGS. 5-9 Although only one example of an element from one embodiment that can be incorporated or utilized in another embodiment has been described above, it should be appreciated that other elements of the various embodiments may be incorporated or utilized with any of the other embodiments disclosed herein.

What is claimed is:

1. A shower system comprising:

a shower frame comprising a plurality of substantially coplanar frame segments forming at least part of a perimeter of the shower frame;

a plurality of nozzles distributed across the plurality of substantially coplanar frame segments and configured to spray water inward from the perimeter of the shower frame; and a shower seat pivotally connected to the shower frame and configured to pivot between a seated position in which the shower seat is substantially perpendicular to the shower frame and a standing position in which the shower seat is substantially parallel to the shower frame.

2. The shower system of claim 1, wherein:

the plurality of substantially coplanar frame segments comprise at least a left side segment, a right side segment, and a top segment connecting the left side segment and the right side segment; and the plurality of nozzles are distributed across the left side segment, the right side segment, and the top segment.

3. The shower system of claim 1, wherein the plurality of nozzles comprise:

a first set of nozzles configured to spray water inward from the perimeter of the shower frame in a direction substantially coplanar with the shower frame; and a second set of nozzles configured to spray water in a direction substantially non-coplanar with the shower frame.

4. The shower system of claim 1, wherein the plurality of nozzles comprise:

a first set of nozzles configured to spray water toward a first zone occupied by a user seated on the shower seat when the shower seat is in the seated position; and a second set of nozzles configured to spray water toward a second zone occupied by a user standing adjacent to the shower frame when the shower seat is in the standing position.

5. The shower system of claim 1, further comprising:

a mounting structure configured to be mounted on a substantially vertical surface; and a support arm comprising a first end pivotally connected to the mounting structure and a second end pivotally connected to the shower frame;

wherein support arm is configured to pivot about the first end to move the shower frame between a first position in which the shower frame is substantially coplanar with the mounting structure and a second position in which the shower frame is offset from the mounting structure.

6. The shower system of claim 1, further comprising a mounting structure configured to be mounted on a substantially vertical surface;

wherein the shower seat is hingedly connected to the mounting structure along a rear edge of the shower seat.

7. The shower system of claim 1, wherein the shower seat is pivotally connected to the shower frame along a side edge of the shower seat such that:

the shower frame moves toward a wall upon which the shower system is mounted when the shower seat moves into the standing position; and the shower frame moves away from the wall upon which the shower system is mounted when the shower seat moves into the seated position.

8. A shower system comprising:

a mounting structure configured to be mounted on a substantially vertical surface;

a shower frame comprising a plurality of substantially coplanar frame segments forming at least part of a perimeter of the shower frame and a plurality of nozzles distributed across the frame segments; and a support arm comprising a first end pivotally connected to the mounting structure and a second end pivotally connected to the shower frame;

wherein support arm is configured to pivot about the first end to move the shower frame between a first position in which the shower frame is substantially coplanar with the mounting structure and a second position in which the shower frame is offset from the mounting structure.

9. The shower system of claim 8, wherein the shower frame comprises one or more feet located along a bottom of the plurality of substantially coplanar frame segments, wherein:

the one or more feet contact a floor of a shower environment in which the shower system is installed when the shower frame is in the second position offset from the mounting structure; and the one or more feet are elevated above the shower floor when shower frame is in the first position substantially coplanar with the mounting structure.

10. The shower system of claim 8, further comprising a shower seat hingedly connected to the mounting structure along a rear edge of the shower seat and configured to pivot between a seated position in which the shower seat is substantially horizontal and a standing position in which the shower seat is substantially vertical.

11. The shower system of claim 10, wherein the shower seat is pivotally connected to the shower frame along a side edge of the shower seat such that:

the shower seat moves into the standing position when the shower frame moves into the first position substantially coplanar with the mounting structure; and the shower seat moves into seated position when the shower frame moves into the second position offset from the mounting structure.

12. The shower system of claim 8, wherein the plurality of substantially coplanar frame segments comprise at least a left side segment, a right side segment, and a top segment connecting the left side segment and the right side segment; and the plurality of nozzles are distributed across the left side segment, the right side segment, and the top segment.

13. The shower system of claim 8, wherein the plurality of nozzles comprise:

a first set of nozzles configured to spray water inward from the perimeter of the shower frame in a direction substantially coplanar with the shower frame; and a second set of nozzles configured to spray water in a direction substantially non-coplanar with the shower frame.

14. The shower system of claim 8, wherein the plurality of nozzles comprise:

a first set of nozzles configured to spray water toward a first zone occupied by a user standing adjacent to the shower frame when the shower frame is in the first position substantially coplanar with the mounting structure; and a second set of nozzles configured to spray water toward a second zone occupied by a user seated within the perimeter of the shower frame when the shower frame is in the second position offset from the mounting structure.

15. A shower system comprising:

a waterway comprising a plurality of nozzles; and a shower seat comprising:

a seat base configured to support a user in a seated position; and a seat back comprising one or more pressable panels located behind the user in the seated position and configured to control a flow of water to the plurality of nozzles.

16. The shower system of claim 15, wherein the one or more pressable panels comprise:

a first pressable panel configured to toggle the flow of water to the waterway on/off; and a second pressable panel configured to change a spray pattern of the flow of water from the plurality of nozzles or direct the flow of water to a subset of the plurality of nozzles.

17. The shower system of claim 15, wherein a pressable panel of the one or more pressable panels is hingedly connected along a bottom edge of the pressable panel and configured to pivot about the bottom edge when pressed.

18. The shower system of claim 15, the seat back further comprising a temperature control slider located along a top surface of the seat back and configured to control a temperature of the water from the plurality of nozzles.

19. The shower system of claim 15, wherein:

the waterway comprises a shower frame comprising a plurality of substantially coplanar frame segments forming at least part of a perimeter of the shower frame; and the plurality of nozzles are distributed across the plurality of substantially coplanar frame segments and configured to spray water inward from the perimeter of the shower frame.

20. The shower system of claim 15, wherein the seat base is pivotally connected to the seat back and configured to pivot between a seated position in which the seat base is substantially perpendicular to the seat back and a standing position in which the seat base is substantially parallel with the seat back.

* * * * *